US012564251B2

(12) United States Patent
Cai

(10) Patent No.: US 12,564,251 B2
(45) Date of Patent: Mar. 3, 2026

(54) ONE-PIECE STRUCTURE OF SHELL AND FILM

(71) Applicant: Shenzhen Caiye Technology Co., Ltd., Shenzhen (CN)

(72) Inventor: Xudong Cai, Shenzhen (CN)

(73) Assignee: Shenzhen Caiye Technology Co., Ltd., Shenzhen City (CN)

( * ) Notice: Subject to any disclaimer, the term of this patent is extended or adjusted under 35 U.S.C. 154(b) by 531 days.

(21) Appl. No.: 18/155,138

(22) Filed: Jan. 17, 2023

(65) Prior Publication Data

US 2023/0232950 A1 Jul. 27, 2023

(30) Foreign Application Priority Data

Jan. 21, 2022 (CN) ..... 202220182171.0

(51) Int. Cl.
*A45C 11/00* (2006.01)

(52) U.S. Cl.
CPC ..... *A45C 11/00* (2013.01); *A45C 11/002* (2025.01)

(58) Field of Classification Search
CPC ..... A45C 11/00; A45C 11/002
See application file for complete search history.

(56) References Cited

U.S. PATENT DOCUMENTS

2017/0013924 A1* 1/2017 Johnson ..... A45F 5/00
2022/0131964 A1* 4/2022 Poon ..... H04M 1/04

* cited by examiner

*Primary Examiner* — Yuwen Pan
*Assistant Examiner* — Fatuma G Sherif

(57) ABSTRACT

The present disclosure proposes a one-piece structure of a shell and a film, including: a protective cover and a bottom shell; wherein the protective cover includes a front frame and a protective film, the front frame being arranged on an outer edge of the protective film; the bottom shell includes a rear frame and a bottom plate arranged on the rear frame; the bottom plate is arranged opposite to the protective film, and the bottom shell is matched with the protective cover to enclose a cavity; an inner surface of the protective film is adhesively fixed to a screen of the electronic device, and the bottom shell is fixedly connected to the electronic device; an avoidance gap is defined between the bottom shell and the protective cover; and/or the bottom shell is in elastic contact with the protective cover.

12 Claims, 33 Drawing Sheets

ONE-PIECE STRUCTURE OF SHELL AND FILM

CROSS REFERENCE

The present application claims foreign priority of Chinese Patent Application No. 202220182171.0, filed on Jan. 21, 2022, in the China National Intellectual Property Administration, the entire contents of which are hereby incorporated by reference in its entirety.

TECHNICAL FIELD

The present disclosure relates to the technical field of protection accessories of electronic devices, and in particular to a one-piece structure of a shell and a film.

BACKGROUND

At present, mainstream mobile phone protection accessories are divided into two categories, one is to protect the screen of the mobile phone, and the other is to protect the body of the mobile phone. In terms of product form, the protection accessories can be divided into only protecting the screen of the mobile phone, only protecting the body of the mobile phone, and the full package of the mobile phone protecting both the screen and the body of the mobile phone.

In order to protect the screen of the mobile phone separately, a common practice is to arrange a film on the screen, such as a soft film or a hard film. The hard film is more popular than the soft film, but the edge of the hard film is easy to shatter. To solve the problem of easy shattering of the edge of the hard film, the related art proposes a protective cover with a border on the edge of the hard film.

In order to protect the body of the mobile phone separately, for example, to protect the side or "side+back" of the body, the related art proposes a separate protective frame or bottom shell. The bottom shell includes a bottom plate and a protective frame arranged around the bottom plate.

In order to protect the screen and the body at the same time, the related art proposes a one-piece structure of a shell and a film, i.e., "protective cover+bottom shell", which is divided into two technical lines. In the first line, a non-adhesive, airy layer exists between a protective film of the protective cover and the screen; in the second line, the protective film of the protective cover and the screen are adhesively attached (hereinafter referred to as an adhesive attachment type). The former has low technical difficulty while with poor display and touch effect; the latter has high technical difficulty, but can ensure the best display and touch effect.

The technical difficulty of the adhesive attachment type of the one-piece structure of a shell and a film is how to reduce the difficulty of assembling the product by the consumer after the one-piece structure of a shell and a film leaves the factory, specifically, to reduce the difficulty of attaching the protective film of the protective cover to the screen without bubbles therebetween. In an existing adhesive attachment type of the one-piece structure of a shell and a film, the protective cover and mobile phone are adhesively fixed, the bottom shell is indirectly fixed relative to the mobile phone through the protective cover, where the protective cover and the bottom shell are snapped together at the upper limit of the thickness direction of the mobile phone, that is, the height of a cavity between the protective film of the protective cover and the bottom plate of the bottom shell is relatively fixed. However, the general error of the thickness of the mobile phone can be up to 100 microns, and the application of the existing one-piece structure of a shell and a film is prone to the situation that the height of the cavity between the protective film and the bottom plate does not match the thickness of the mobile phone. In this way, when the height of the cavity is less than the thickness of the mobile phone and the difference is too large, the protective film is squeezed outward by the mobile phone, and the protective film arches outward; when the height of the cavity is greater than the thickness of the mobile phone and the difference is too large, the protective film will sink inward in the central region under the adhesion force, and the edge part will buckle up to the side away from the screen. In either case, air bubbles will be generated when the protective film is attached to the screen, making it difficult to realize the function of the product, which will inevitably lead to a large number of customer complaints.

SUMMARY OF THE DISCLOSURE

The purpose of the present disclosure is to provide a one-piece structure of a shell and a film, which aims to solve the technical problem that after the existing one-piece structure of a shell and a film is installed in the electronic device, air bubbles are easily generated between the protective film and the screen of the electronic device, and the functions of the product are difficult to be realized.

In order to achieve the above purpose, the present disclosure proposes a one-piece structure of a shell and a film, including: a protective cover and a bottom shell; wherein,

- the protective cover includes a front frame and a protective film, the front frame being arranged on an outer edge of the protective film;
- the bottom shell includes a rear frame and a bottom plate arranged on the rear frame; the bottom plate is arranged opposite to the protective film, and the bottom shell is matched with the protective cover to enclose a cavity for accommodating the electronic device;
- an inner surface of the protective film is adhesively fixed to a screen of the electronic device, and the bottom shell is fixedly connected to the electronic device;
- an avoidance gap is defined between the bottom shell and the protective cover in a thickness direction of the electronic device; and/or
- the bottom shell is in elastic contact with the protective cover in the thickness direction of the electronic device.

In some embodiments, a bottom surface of the front frame and a top surface of the rear frame are arranged opposite each other in the thickness direction of the electronic device and define a first avoidance gap.

In some embodiments, the top surface of the rear frame is arranged with a lower positioning projection, and the bottom surface of the front frame is arranged with an upper positioning recess facing the lower positioning projections; the lower positioning projection is disposed in the upper positioning recess, and a second avoidance gap is defined between the lower positioning projection and the upper positioning recess in the thickness direction of the electronic device; in a direction parallel to the screen of the electronic device and toward a center of the screen of the electronic device, the second avoidance gap is closer to the protective film than the first avoidance gap; in the thickness direction of the electronic device, the second avoidance gap is larger than the first avoidance gap.

In some embodiments, the lower positioning projection is arranged at a connection between the top surface of the rear frame and an inner wall surface of the rear frame, and the lower positioning projection protrudes from the inner wall surface of the rear frame to fasten a front side of the electronic device.

In some embodiments, a side of the lower positioning projection back from the upper positioning recess is a concave arc surface.

In some embodiments, the lower positioning projection includes a plurality of lower positioning projections, and the plurality of lower positioning projections are arranged at intervals along a circumference of the rear frame.

In some embodiments, a mounting slot is defined at a connection between the bottom surface and an inner peripheral surface of the front frame, and the bottom surface of the front frame defines an exhaust slot, being annular in shape, at a periphery of the mounting slot; the exhaust slot is in communication with the mounting slot and the upper positioning recess, and an edge of the protective film is fixedly arranged in the mounting slot.

In some embodiments, the lower positioning protrusion extends along a circumferential direction of the rear frame and is strip-shaped.

In some embodiments, an upper surface of the lower positioning protrusion has a trapezoidal or triangular cross-sectional shape that tapers from a bottom to a top, and an inner wall surface of the upper positioning recess has a similar shape to the lower positioning protrusion.

In some embodiments, in the thickness direction of the electronic device, a thickness between the bottom surface and a top surface of the front frame is less than a height of the rear frame;

the bottom surface of the front frame is arranged with an upper positioning projection and the top surface of the rear frame defines a lower positioning recess, and a third avoidance gap is defined between the upper positioning projection and the lower positioning recess in the thickness direction of the electronic device;

a height of the upper positioning projection is greater than a height of the lower positioning projection; in the direction parallel to the screen of the electronic device and toward the center of the screen of the electronic device, the third avoidance gap is closer to the protective film than the first avoidance gap; in the thickness direction of the electronic device, the third avoidance gap is larger than the first avoidance gap, and the third avoidance gap is smaller than the second avoidance gap.

In some embodiments, in the thickness direction of the electronic device, a height of the bottom surface of the front frame is close to a height of the inner surface of the protective film, and the thickness between the bottom surface and the top surface of the front frame is 1.5 times to 3 times of a thickness of the protective film.

In some embodiments, the front frame and the rear frame are both rectangular frames, the front frame including two first long frame strips arranged opposite each other and two first short frame strips arranged opposite each other, and the rear frame including two second long frame strips arranged opposite each other and two second short frame strips arranged opposite each other;

the upper positioning projection includes a plurality of upper positioning projections, and the upper positioning recess includes a plurality of upper positioning recesses; the lower positioning recess includes a plurality of lower positioning recesses, and the lower positioning projection includes a plurality of lower positioning projections;

a central part of each first long frame strip is arranged with two of the plurality of upper positioning projections arranged at intervals in a length direction of the first long frame strip, and one of the plurality of upper positioning recess is arranged between the two upper positioning projections;

a central part of each second long frame strip is arranged with two of the plurality of lower positioning recesses arranged at intervals in a length direction of the second long frame strip, and one of the plurality of lower positioning projections is arranged on a top surface of the second long frame strip between the two lower positioning recesses.

In some embodiments, the bottom surface of the front frame is arranged with an upper positioning projection, and the top surface of the rear frame defines a lower positioning recess, and a third avoidance gap is defined between the upper positioning projection and the lower positioning recess in the thickness direction of the electronic device; in a direction parallel to the screen of the electronic device and toward a center of the screen of the electronic device, the third avoidance gap is closer to the protective film than the first avoidance gap; in the thickness direction of the electronic device, the third avoidance gap is larger than the first avoidance gap.

In some embodiments, the lower positioning recess runs through an inner wall surface of the rear frame to define a slot open toward the cavity.

In some embodiments, the lower positioning recess includes a first slot wall surface, a bottom wall surface, and two second slot wall surfaces, the first slot wall surface facing a center of the cavity, the bottom wall surface spaced from the upper positioning projection to define the third avoidance gap, and the two second slot wall surfaces arranged opposite each other in a circumferential direction of the rear frame;

at least one of a connection of the first slot wall surface with the top surface of the rear frame and a connection of the two second slot wall surfaces with the top surface of the rear frame is arranged with a guiding bevel or a curved surface, for expanding an upper opening of the lower positioning recess.

The one-piece structure of the present disclosure adopts a fixed structure in which "the protective cover and the bottom shell are fixed to the electronic device, respectively", i.e., the bottom shell is not fixed to the electronic device by the protective cover.

The height of the front frame of the protective cover and the height of the rear frame of the bottom shell are set so that the bottom shell and the protective cover define an avoidance gap in the thickness direction of the electronic device.

And/or, the structure and material of the front frame of the protective cover and the structure and material of the rear frame of the bottom shell are set so that the bottom shell and the protective cover 10 form an elastic contact in the thickness direction of the electronic device.

Therefore, the height of the cavity between the protective film of the protective cover and the bottom plate of the bottom shell is always in a suitable state to match the thickness of the electronic device, provided that the protective film is not overly deformed by this adaptive change of the avoidance gap and/or the pre-determined degree of elastic deformation. Without squeezing and stretching, the protective film 18 may easily expel air bubbles when attached, which reduces the difficulty of installing the protective cover "without air bubbles", thereby improving the user experience.

BRIEF DESCRIPTION OF THE DRAWINGS

In order to more clearly illustrate the technical solutions in the embodiments of the present disclosure, the following is a brief description of the accompanying drawings used in the description of the embodiments, and it is obvious that the following description of the accompanying drawings are only some embodiments of the present disclosure. For those skilled in the art, without creative work, other drawings can be obtained based on these drawings.

DETAILED DESCRIPTION

Figure 1:
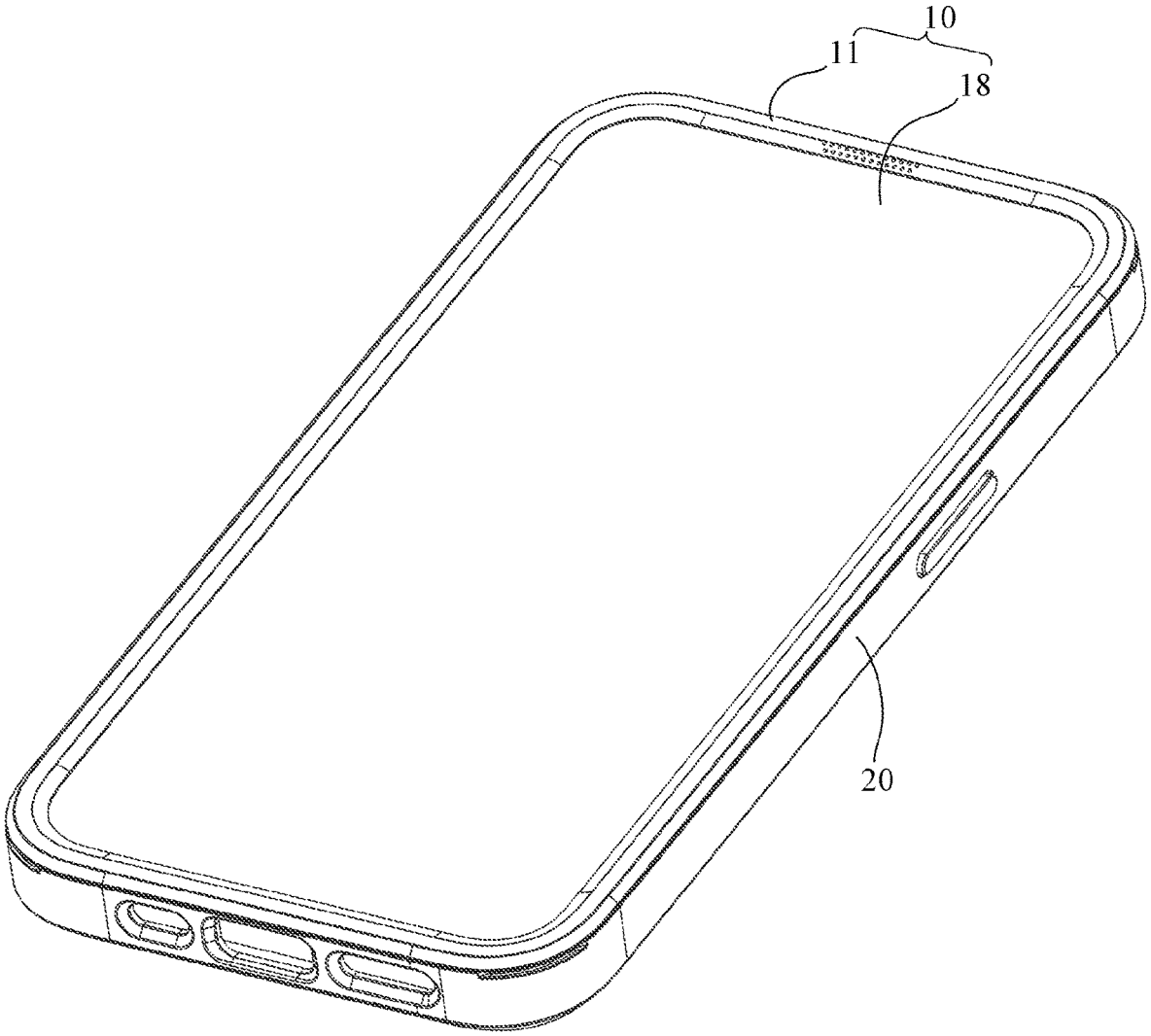
FIG. 1 is a perspective structural schematic view of a one-piece structure of a shell and a film, matched with a mobile phone, according to an embodiment of the present disclosure.
Figure 2:
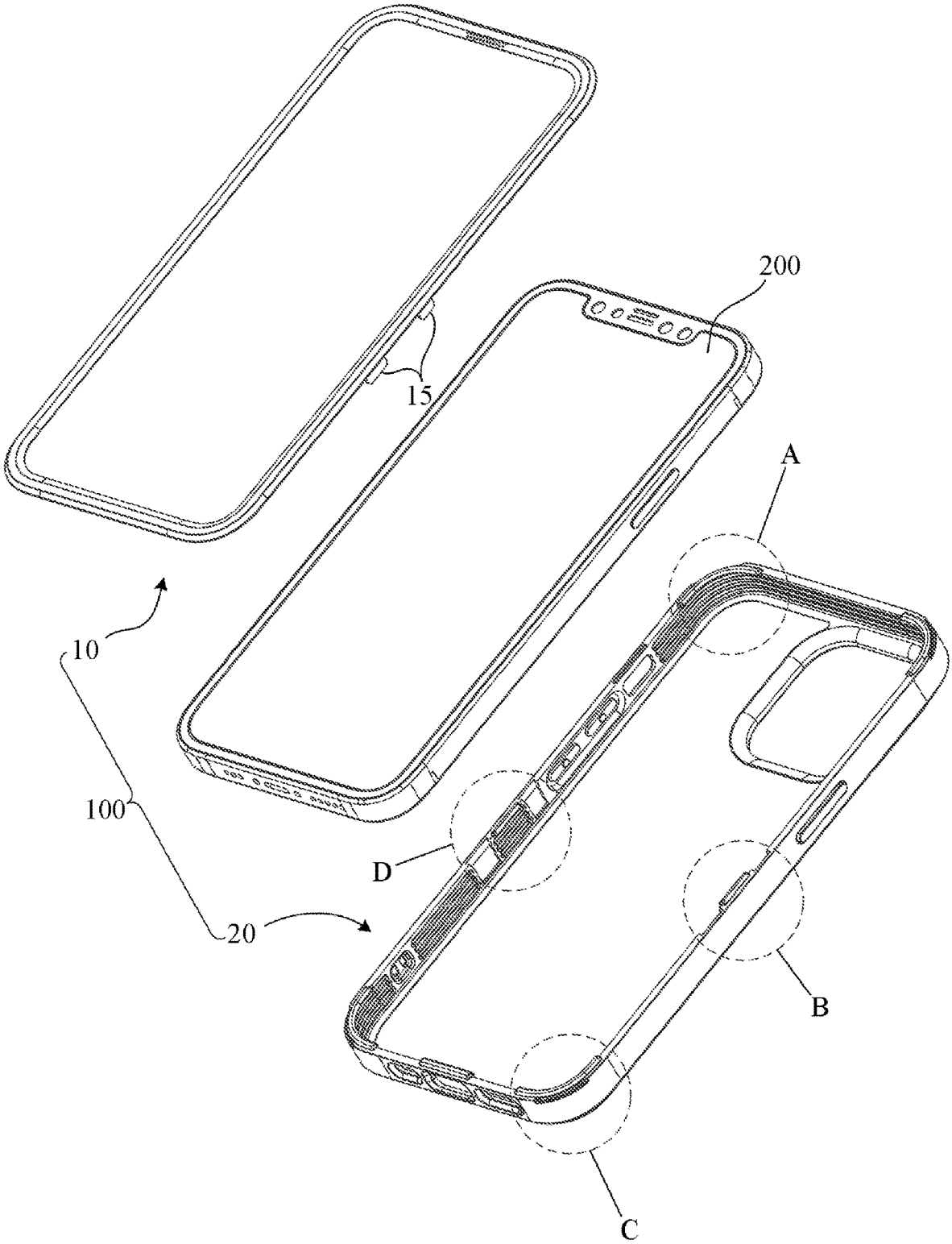
FIG. 2 is an exploded schematic view of the structure in FIG. 1.
Figure 3:
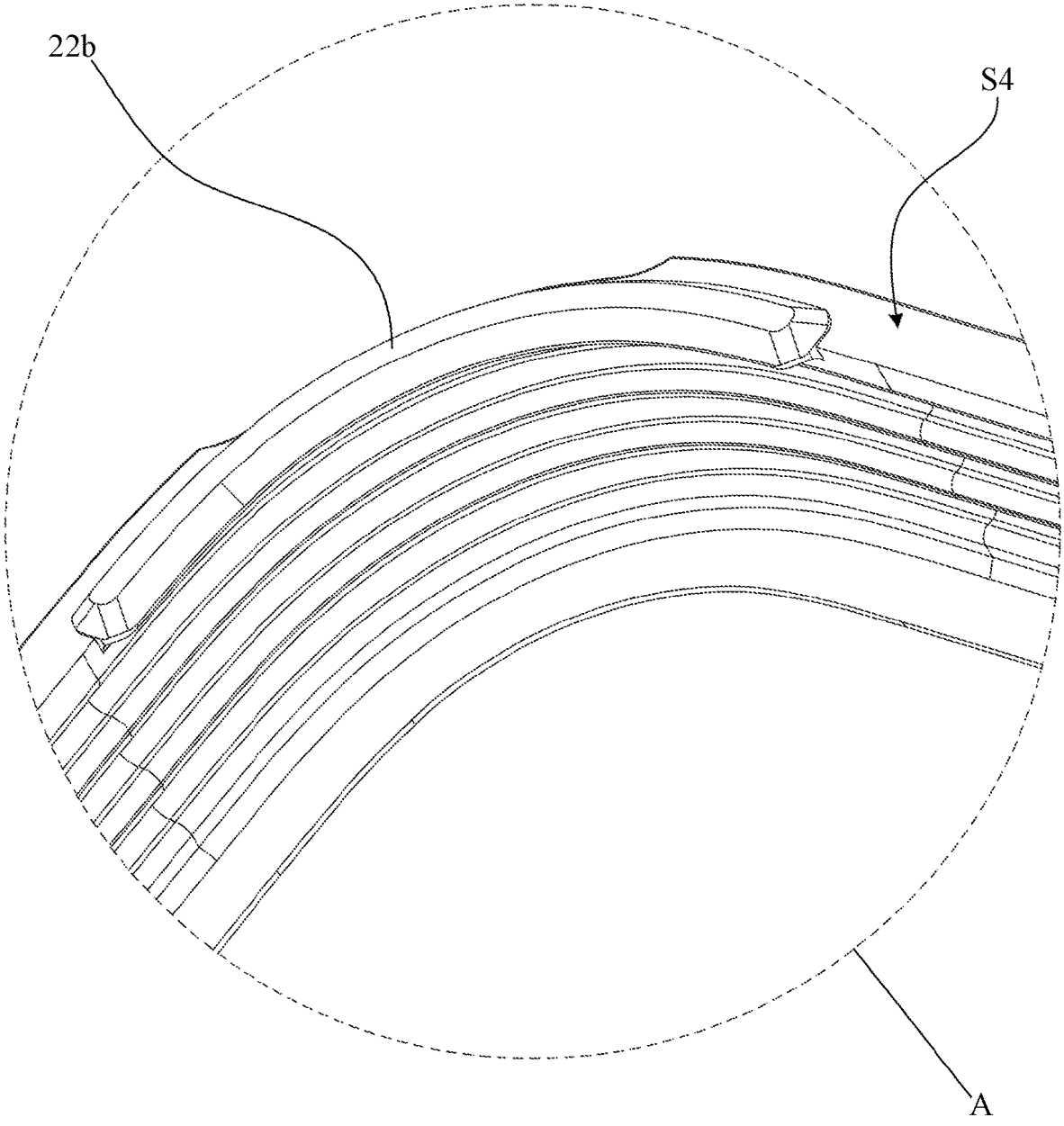
FIG. 3 is an enlarged view of region A circumscribed in FIG. 2.
Figure 4:
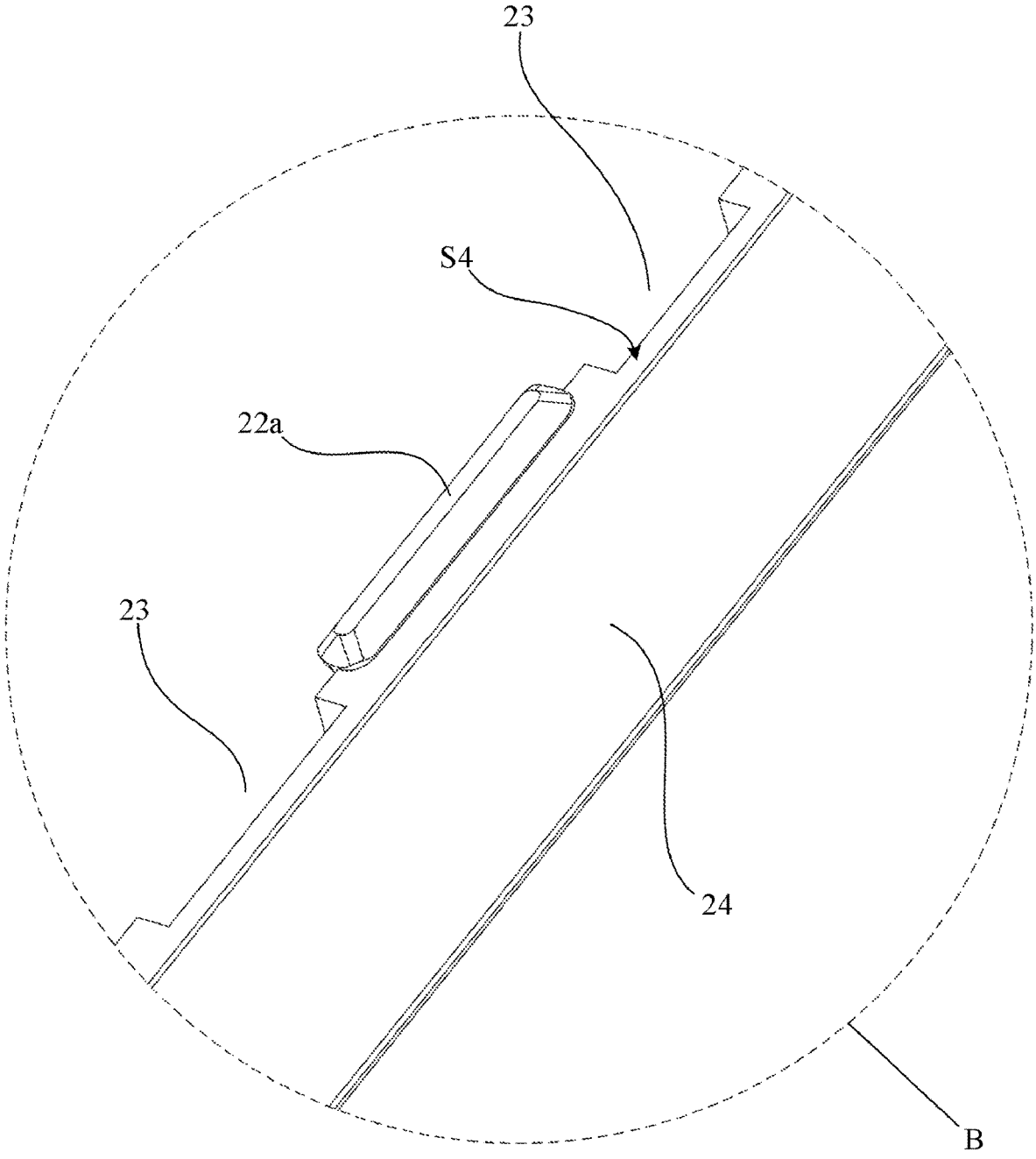
FIG. 4 is an enlarged view of region B circumscribed in FIG. 2.
Figure 5:
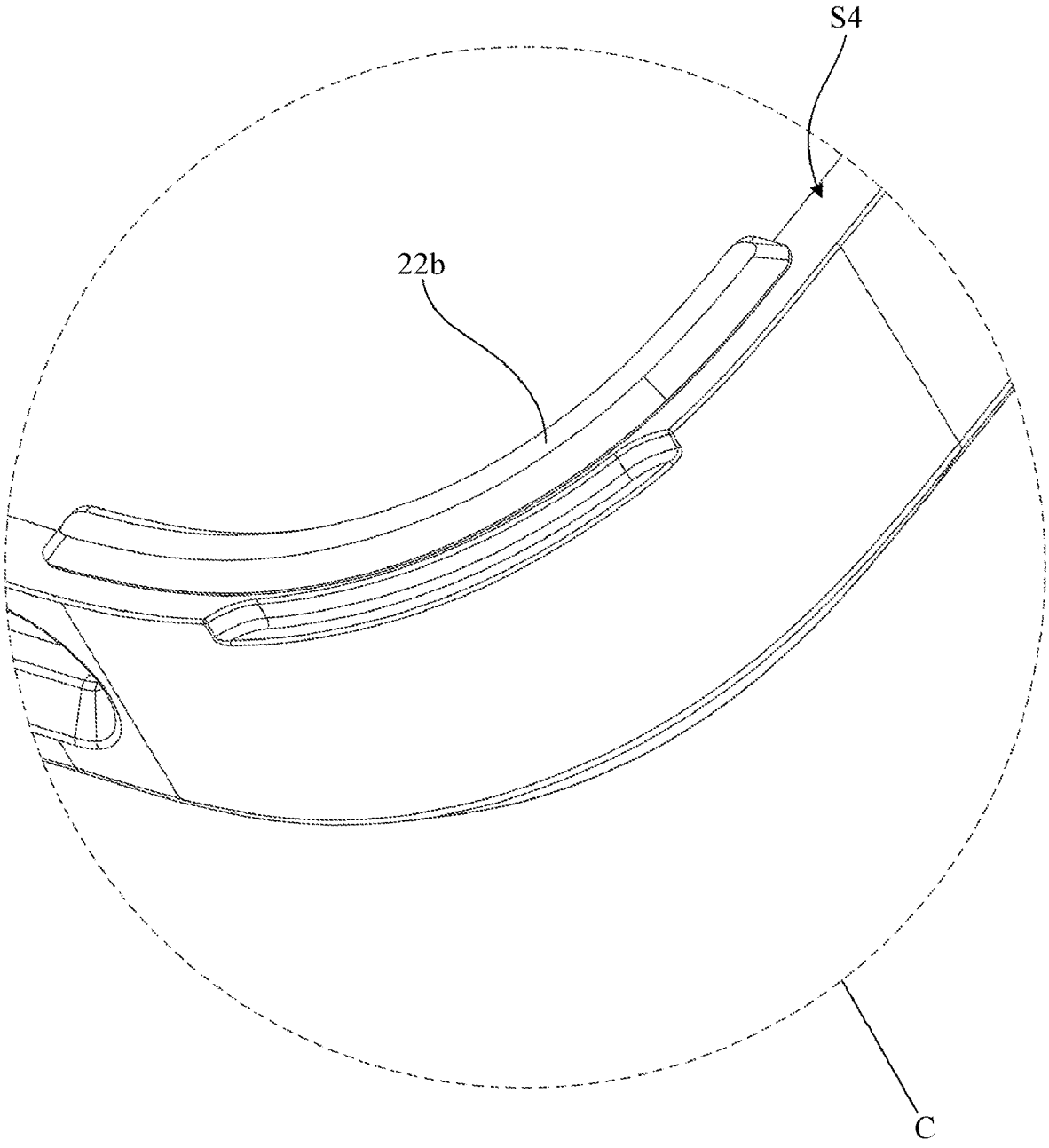
FIG. 5 is an enlarged view of region C circumscribed in FIG. 2.
Figure 6:
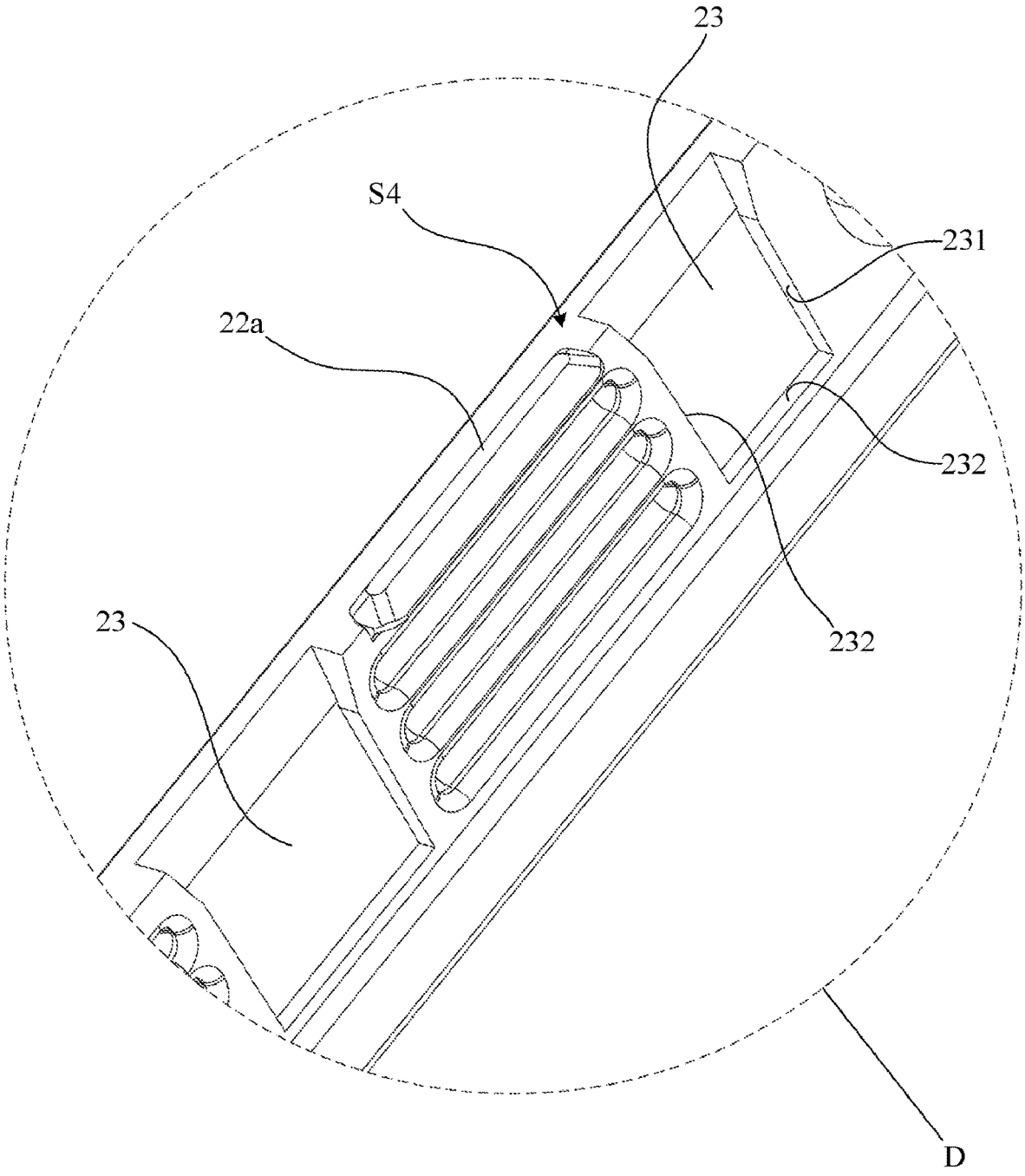
FIG. 6 is an enlarged view of region D circumscribed in FIG. 2.
Figure 7:
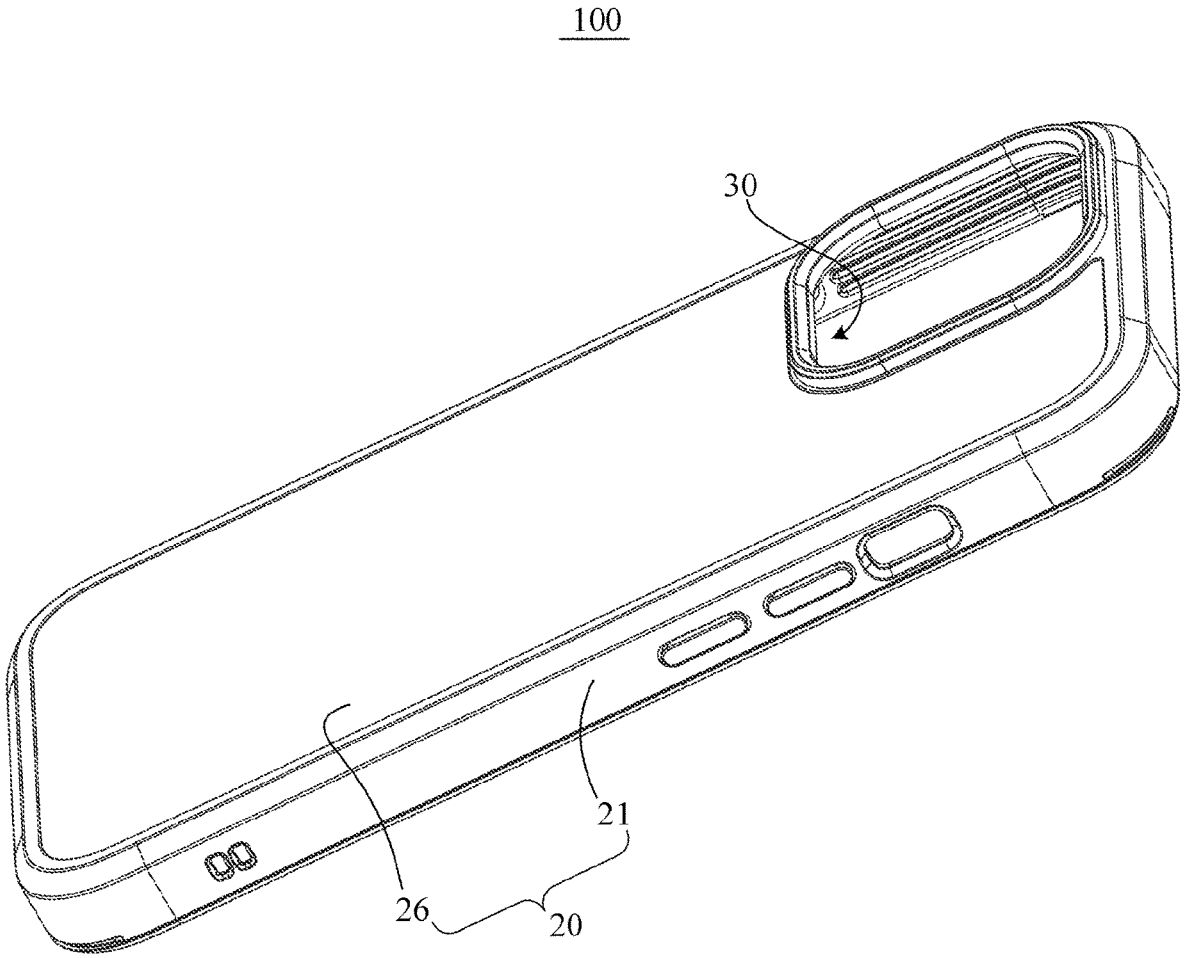
FIG. 7 is a perspective structural schematic view of the one-piece structure in FIG. 1 from another angle.
Figure 8:
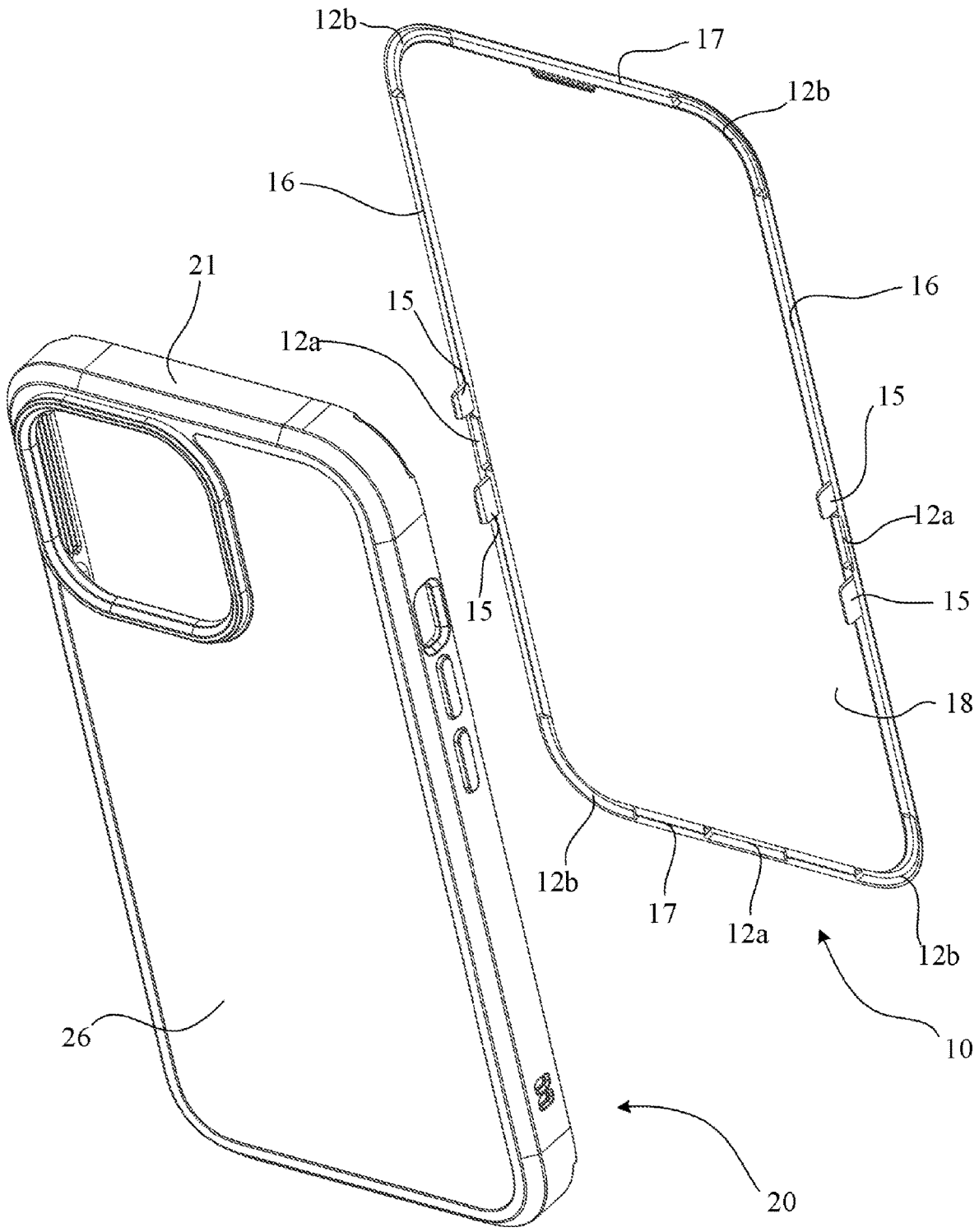
FIG. 8 is an exploded schematic view of the structure in FIG. 7.
Figure 9:
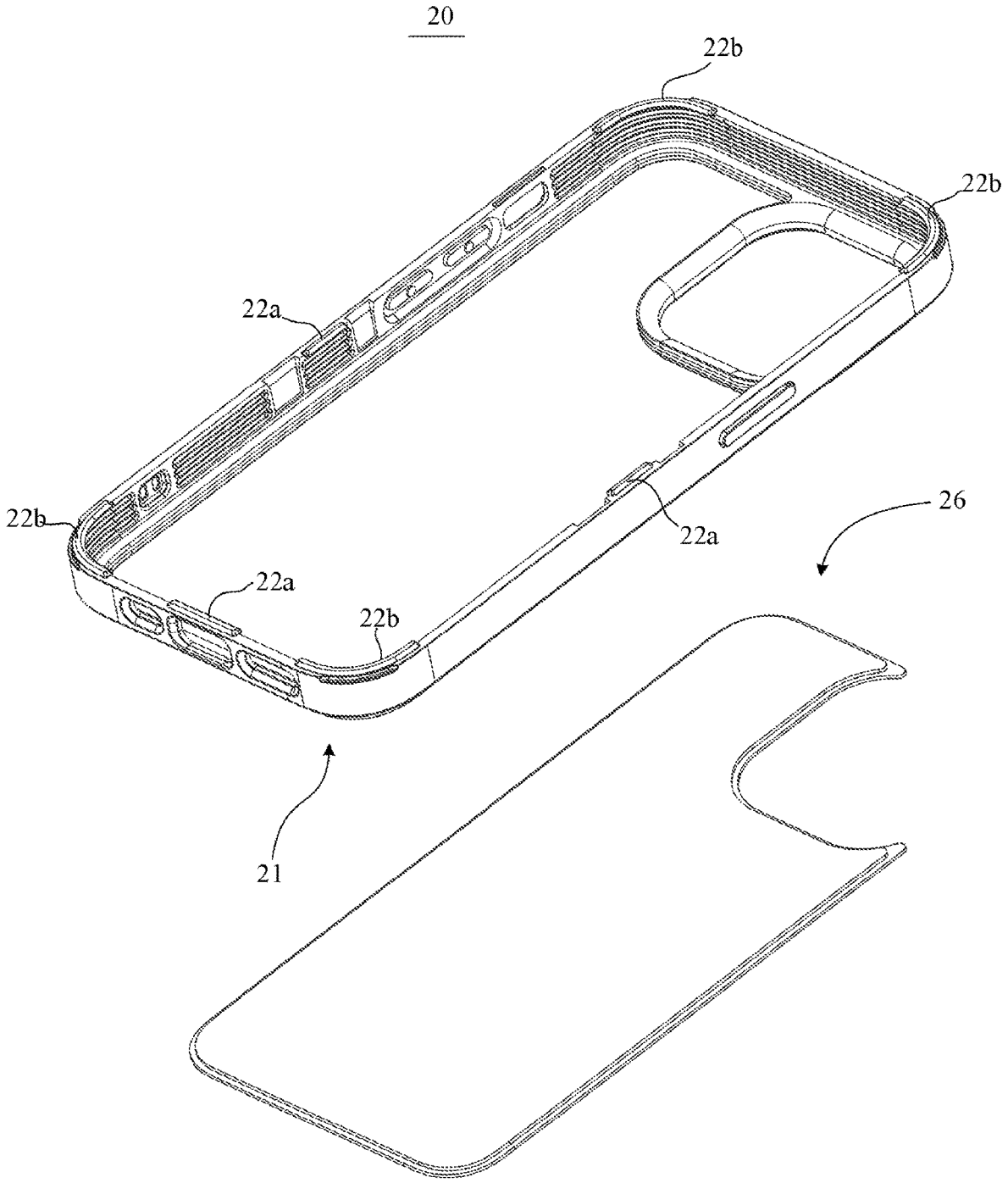
FIG. 9 is an exploded structural schematic view of a bottom shell in FIG. 8.
Figure 10:
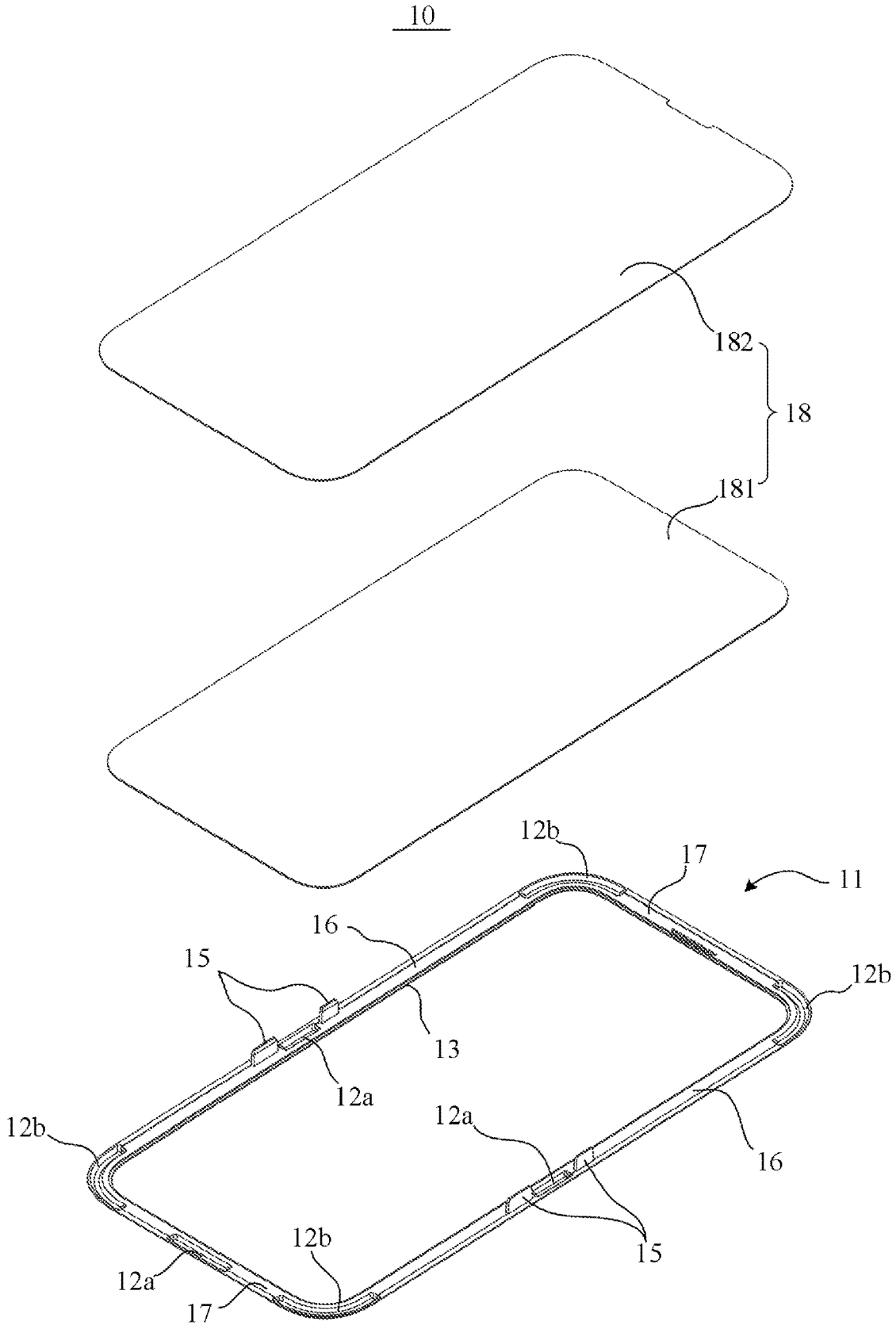
FIG. 10 is an exploded structural schematic view of a protective cover in FIG. 8.
Figure 11:
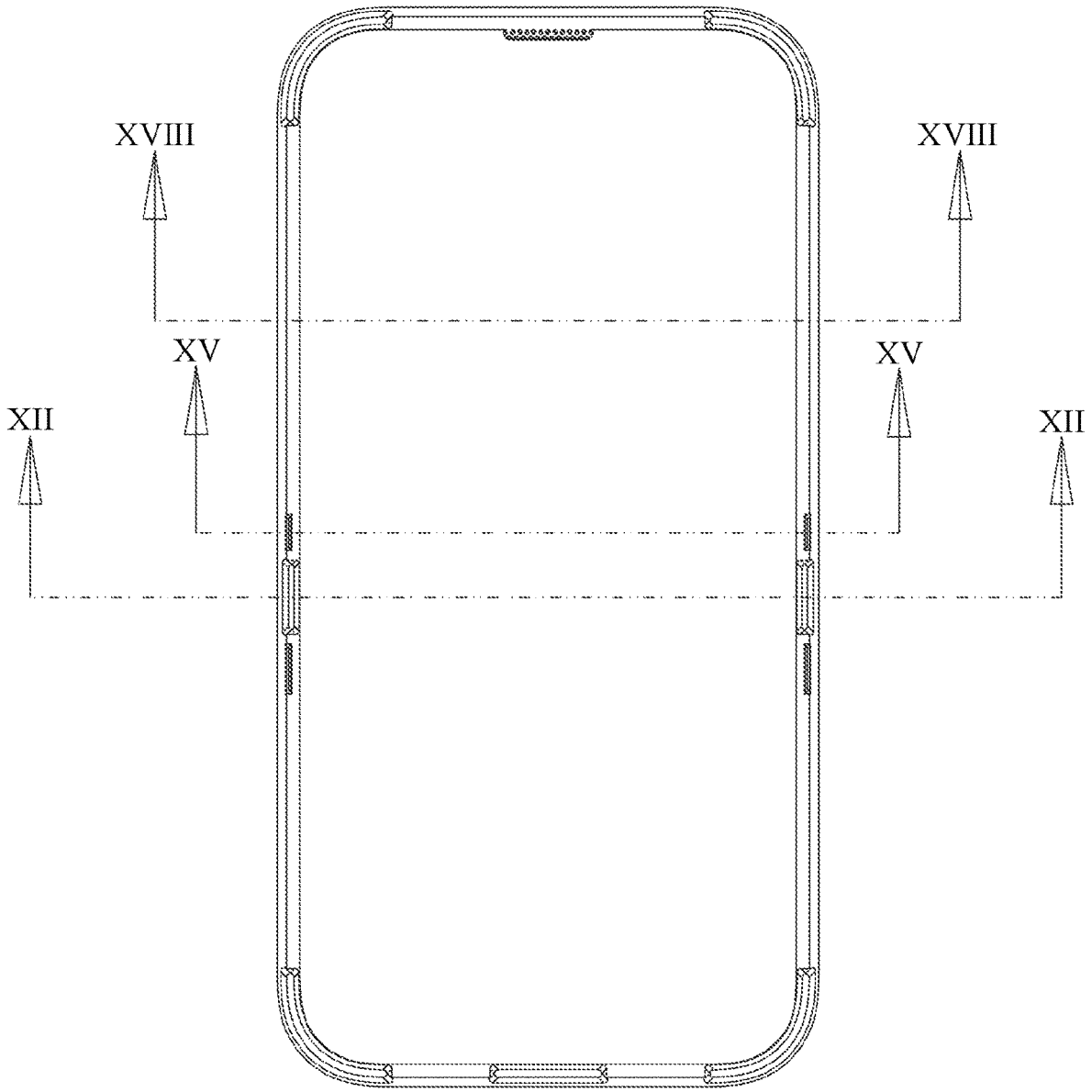
FIG. 11 is a schematic view of a back orthographic projection of a protective cover in FIG. 8.
Figure 12:
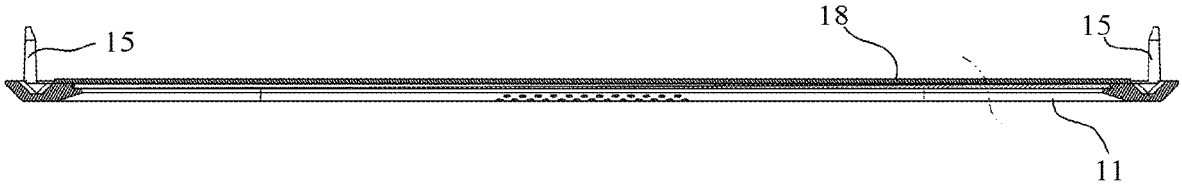
FIG. 12 is a sectional structural schematic view along line XII-XII in FIG. 11.
Figure 13:
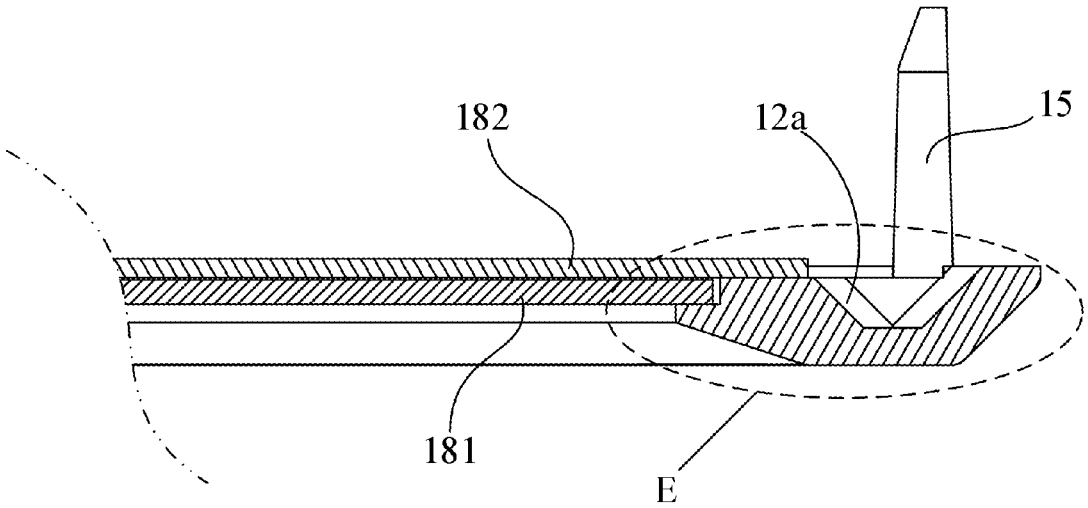
FIG. 13 is a partial structural schematic view on a right side in FIG. 12.

The following will be a clear and complete description of the technical solutions in the embodiments of the present disclosure in conjunction with the accompanying drawings in the embodiments of the present disclosure. Obviously, the embodiments described are only a part of the embodiments of the present disclosure, and not all of them. Based on the embodiments in the present disclosure, all other embodiments obtained by those skilled in the art without making creative labor fall within the scope of the present disclosure.

For the above purpose, with reference to FIGS. 1, 2, 7 to 11, and 21 to 33, in some embodiments, the present disclosure proposes a one-piece structure 100 of a shell and a film, which includes a protective cover 10 and a bottom shell 20.

The protective cover 10 includes a front frame 11 and a protective film 18, the front frame 11 being arranged on an outer edge of the protective film 18.

The bottom shell 20 includes a rear frame 21 and a bottom plate 26 arranged on the rear frame 21; the bottom plate 26 is arranged opposite to the protective film 18, and the bottom shell 20 is matched with the protective cover 10 to enclose a cavity 30 for accommodating the electronic device 200.

An inner surface of the protective film 18 is adhesively fixed to a screen of the electronic device 200 and the bottom shell 20 is fixedly connected to the electronic device 200.

An avoidance gap is defined between the bottom shell 20 and the protective cover 10 in a thickness direction of the electronic device 200.

And/or, the bottom shell 20 is in elastic contact with the protective cover 10 in the thickness direction of the electronic device 200.

In the embodiments, the front frame 11 is usually an injection molded part, and the protective film 18 may be a multi-layer structure, including, for example, a tempered glass layer and a self-adhesive layer bonded to the tempered glass layer. The front frame 11 and the protective film 18 may be secondary injection molded, or be fixed by self-adhesive adhesive or glue; the rear frame 21 is usually an injection molded part or a metal frame; when the rear frame 21 is an injection molded part, the rear frame and the bottom plate 26 may also be secondary injection molded. In order to facilitate the show of the logo or pattern on the back of the electronic device 200, the bottom plate 26 may be transparent.

In a circumferential direction of a mating position between the bottom shell 20 and the protective cover 10, there may be a full circle of avoidance gaps or a full circle of elastic contacts between the two, or the avoidance gap setting and the elastic contact setting are arranged alternately. The advantage of the circumferential direction between the bottom shell 20 and the protective cover 10 with a full circle of elastic contact setting is that the gap between the bottom shell 20 and the protective cover 10 may be hidden.

The electronic device 200 is usually a mobile phone, and the electronic device 200 may be other portable devices with a display.

The one-piece structure 100 of the present disclosure adopts a fixed structure in which "the protective cover 10 and the bottom shell 20 are fixed to the electronic device 200, respectively", i.e., the bottom shell 20 is not fixed to the electronic device 200 by the protective cover 10.

The height of the front frame 11 of the protective cover 10 and the height of the rear frame 21 of the bottom shell 20 are set so that the bottom shell 20 and the protective cover 10 define an avoidance gap in the thickness direction of the electronic device 200.

And/or, the structure and material of the front frame 11 of the protective cover 10 and the structure and material of the rear frame 21 of the bottom shell 20 are set so that the bottom shell 20 and the protective cover 10 form an elastic contact in the thickness direction of the electronic device 200.

Therefore, the height of the cavity 30 between the protective film 18 of the protective cover 10 and the bottom plate 26 of the bottom shell 20 is always in a suitable state to match the thickness of the electronic device 200, provided that the protective film 18 is not overly deformed by this adaptive change of the avoidance gap and/or the pre-determined degree of elastic deformation. Without squeezing and stretching, the protective film 18 may easily expel air bubbles when attached, which reduces the difficulty of installing the protective cover 10 "without air bubbles", thereby improving the user experience.

Further, a bottom surface S1 of the front frame 11 and a top surface S4 of the rear frame 21 are arranged opposite each other in the thickness direction of the electronic device 200 and define a first avoidance gap G1.

In the embodiments, for setting the first avoidance gap G1 to adapt to different thicknesses of the electronic device 200, it is only required to adjust the height of parts adjacent to each other between the protective cover 10 and the bottom shell 20, such as the height of the front frame 11 and the height of the rear frame 21, thus the manufacturing cost is lower.

Further, referring together to FIGS. 3 to 6, the top surface of the rear frame 21 is arranged with lower positioning projections 22*a*, 22*b*, and the bottom surface of the front frame 11 is arranged with upper positioning recesses 12*a*, 12*b* facing the lower positioning projections 22*a*, 22*b*; the lower positioning projections 22*a*, 22*b* are disposed in the upper positioning recesses 12*a*, 12*b*, and a second avoidance gap G2 is defined between the lower positioning projections 22*a*, 22*b* and the upper positioning recesses 12*a*, 12*b* in the thickness direction of the electronic device 200; in a direction parallel to the screen of the electronic device 200 and toward the center of the screen of the electronic device 200, the second avoidance gap G2 is closer to the protective film 18 than the first avoidance gap G1; in the thickness direction of the electronic device 200, the second avoidance gap G2 is larger than the first avoidance gap G1.

In the embodiments, the lower positioning projections 22*a*, 22*b* and the upper positioning recesses 12*a*, 12*b* may cooperate to help the user to position the protective cover 10, for the subsequent attachment work ready. The second avoidance gap may prevent the positioning fit between an upper positioning projection 15 and a lower positioning recess 23 from affecting the adaptability of the height of the cavity 30 between the protective film 18 and the bottom plate 26 of the bottom shell 20 and the thickness of the electronic device 200. The farther away from the electronic device 200 in the direction parallel to the screen of the electronic device 200 and toward the center of the screen of the electronic device 200, the less the amount of the resulting deformation transmitted to the protective film 18 even if the avoidance gap is eliminated and the extrusion occurs at that position, and the easier to be observed from the outside. Therefore, to hide the first avoidance gap G1 in a more external position as much as possible, and to make the protective film 18 easy to attach, the second avoidance gap G2 is larger than the first avoidance gap G1 in the thickness direction of the electronic device 200.

Further, the lower positioning projections 22*a*, 22*b* are arranged at a connection between the top surface of the rear frame 21 and the inner wall surface of the rear frame 21, and the lower positioning projections 22*a*, 22*b* protrude from the inner wall surface of the rear frame 21 to fasten the front side of the electronic device 200.

In the embodiments, the lower positioning projections 22*a*, 22*b* can not only play a positioning role, but also can play a role of limiting the electronic device 200 to make the bottom shell 20 fixed relative to the electronic device 200. The lower positioning projections 22*a*, 22*b* are arranged at the connection between the top surface of the rear frame 21 and the inner wall surface of the rear frame 21, so that the second avoidance gap can be better staggered with the first avoidance gap in the direction parallel to the screen of the electronic device 200 and toward the center of the screen of the electronic device 200, and the width of the rear frame 21 is kept at a narrow level. In some embodiments, the side of the lower positioning projection 22*a*, 22*b* back from the upper positioning recess 12*a*, 12*b* is a concave arc surface, which may better fit the rounded corners of the electronic device 200, and the structure is compact and more firmly limited.

Further, to limit the electronic device 200 more evenly, the lower positioning projections 22*a*, 22*b* are arranged in a plurality, and the multiple lower positioning projections 22*a*, 22*b* are arranged at intervals along the circumference of the rear frame 21.

Further, a mounting slot 13 is defined at a connection between the bottom surface and the inner peripheral surface of the front frame 11, and the bottom surface of the front frame 11 defines an annular exhaust slot 14 at the periphery of the mounting slot 13; the exhaust slot 14 is in communication with the mounting slot 13 and the upper positioning recesses 12*a*, 12*b*, and the edge of the protective film 18 is fixedly arranged in the mounting slot 13.

In the embodiments, the exhaust slot 14 may increase the flexibility of an edge part of the front frame 11, thereby increasing the overall flexibility of the protective cover 10 and facilitating the attachment operation; on the other hand, it may accelerate the air exhaust between the protective cover 10 and the screen of the electronic device 200, so that the attachment operation takes less time, which further optimizes the user's use experience.

Further, the lower positioning protrusions 22*a*, 22*b* extend along the circumferential direction of the rear frame 21 and are strip-shaped, which allows for enhanced positioning without increasing the width of the rear frame 21. In some embodiments, to increase the guiding effect, the upper surface of the lower positioning protrusions 22*a*, 22*b* has a trapezoidal or triangular cross-sectional shape that tapers from the bottom to the top, and the inner wall surface of the upper positioning recesses 12*a*, 12*b* has a similar shape to the lower positioning protrusions 22*a*, 22*b*.

Further, in the thickness direction of the electronic device 200, the thickness between the bottom surface and the top surface of the front frame 11 is less than the height of the rear frame 21.

The bottom surface of the front frame 11 is arranged with the upper positioning projection 15 and the top surface of the rear frame 21 defines the lower positioning recess 23, and a third avoidance gap G3 is defined between the upper positioning projection 15 and the lower positioning recess 23 in the thickness direction of the electronic device 200.

The height of the upper positioning projection 15 is greater than the height of the lower positioning projections 22*a*, 22*b*; in the direction parallel to the screen of the electronic device 200 and toward the center of the screen of the electronic device 200, the third avoidance gap G3 is closer to the protective film 18 than the first avoidance gap G1; in the thickness direction of the electronic device 200, the third avoidance gap G3 is larger than the first avoidance gap G1, and the third avoidance gap G3 is smaller than the second avoidance gap G2.

In the embodiments, the height of the front frame 11 is less than the height of the rear frame 21, so that arranging the upper positioning projection 15 on the front frame 11 is more conducive to ensuring the strength of the front frame 11 while ensuring the positioning fit length than arranging the slot-like cavity structure on the front frame 11. The upper positioning projection 15 cooperates with the lower positioning recess 23 to help the user position the protective cover 10 and pave the way for subsequent attachment. The height of the upper positioning projection 15 is greater than the height of the lower positioning projections 22*a*, 22*b*, so that the upper positioning projection 15 and the lower positioning recess 23 can pre-form a positioning structure during the attachment process and become the main positioning structure; and the lower positioning projections 22*a*, 22*b* then cooperate with the upper positioning projection 15 to further fine-tune the position of the protective cover 10 during the later process of the assembly of the front frame 11 from top to bottom. In this way, the initial alignment of the positioning operation is facilitated and the positioning accuracy is ensured. Setting the third avoidance gap G3 may avoid the positioning fit between the upper positioning projection 15 and the lower positioning recess 23 from affecting the adaptability of the height of the cavity 30 between the protective film 18 and the bottom plate 26 of the bottom shell 20 and the thickness of the electronic device 200. Similar to the embodiments where the second avoidance gap G2 is set, the third avoidance gap G3 is larger than the first avoidance gap G1 in the thickness direction of the electronic device 200, which can ensure that the protective film 18 is easy to attach while hiding the first avoidance gap G1 in a more external position as much as possible.

Further, in the thickness direction of the electronic device 200, the height of the bottom surface of the front frame 11 is close to the height of the inner surface of the protective film 18, and the thickness between the bottom surface and the top surface of the front frame 11 is 1.5 times to 3 times of the protective film 18.

In the embodiments, since the thickness of the protective film 18 is usually small, limiting the thickness of the front frame 11 to a less value with reference to the thickness of the protective film 18 makes the protective cover 10 as a whole tend to be more of a plate-like structure, thereby making the protective cover 10 easier to bend, i.e., while preventing the protective film 18 from coming off the frame and protecting the edge part of the protective film 18, it is also easy to implement the attachment operation of the protective film 18.

Further, referring to FIGS. 2 to 10, the front frame 11 and the rear frame 21 are both rectangular frames, the front frame 11 including two first long frame strips 16 arranged opposite each other and two first short frame strips 17 arranged opposite each other; the rear frame 21 including two second long frame strips 24 arranged opposite each other and two second short frame strips 25 arranged opposite each other.

A central part of each first long frame strip 16 is arranged with two upper positioning projections 15 arranged at intervals in the length direction of the first long frame strip 16, and an upper positioning recess 12*a*, 12*b* is arranged between the two upper positioning projections 15.

A central part of each second long frame strip 24 is arranged with two lower positioning recesses 23 arranged at intervals in the length direction of the second long frame strip 24, and a lower positioning projection 22*a*, 22*b* is arranged on the top surface of the second long frame strip 24 between the two lower positioning recesses 23.

In the embodiments, compared to aligning the first short frame strip 17 of the front frame 11 with the second short frame strip 25 of the rear frame 21, the user aligns the first long frame strip 16 of the front frame 11 with the second long frame strip 24 of the rear frame 21 to align the upper positioning projection 15 with the lower positioning recess 23, and the upper positioning recesses 12*a*, 12*b* with the lower positioning projections 22*a*, 22*b*, and the operation is therefore easier due to the longer distance available for pre-positioning. The upper positioning recess 12*a*, 12*b* is arranged between the two upper positioning projections 15 on each first long frame strip 16, which cooperates with the lower positioning recesses 23 and lower positioning projections 22*a*, 22*b* on the second long frame strip 24, so that the above design functions as a tooth row engagement, which facilitates operation and helps to improve positioning accuracy.

Further, the bottom surface of the front frame 11 is arranged with an upper positioning projection 15, and the top surface of the rear frame 21 defines a lower positioning recess 23, and a third avoidance gap G3 is defined between the upper positioning projection 15 and the lower positioning recess 23 in the thickness direction of the electronic device 200; in the direction parallel to the screen of the electronic device 200 and toward the center of the screen of the electronic device 200, the third avoidance gap is closer to the protective film 18 than the first avoidance gap; in the thickness direction of the electronic device 200, the third avoidance gap is larger than the first avoidance gap.

In the embodiments, the upper positioning projection 15 and the lower positioning recess 23 may help the user to position the protective cover 10 and pave the way for the subsequent attachment work. Arranging the upper positioning projection 15 on the front frame 11 is conducive to making the height of the front frame 11 low while ensuring the structural strength of the front frame 11. Setting the third avoidance gap G3 may avoid the positioning fit between the upper positioning projection 15 and the lower positioning recess 23 from affecting the adaptability of the height of the cavity 30 between the protective film 18 and the bottom plate 26 of the bottom shell 20 and the thickness of the electronic device 200. Similar to the embodiments where the second avoidance gap G2 is set, the third avoidance gap G3 is larger than the first avoidance gap G1 in the thickness direction of the electronic device 200, which may ensure that the protective film 18 is easy to attach while hiding the first avoidance gap G1 in a more external position as much as possible.

Further, the lower positioning recess 23 runs through the inner wall surface of the rear frame 21 to define a slot open toward the cavity 30. In this way, the side of the electronic device 200 and the lower positioning recess 23 may be enclosed to define a positioning cavity in which the upper positioning projection 15 can be placed. Since the lower positioning recess 23 is open, the thickness of the rear frame 21 can be made as narrow as possible.

Further, referring again to FIG. 6, the lower positioning recess 23 includes a first slot wall surface 231, a bottom wall surface 232, and two second slot wall surfaces 233, the first slot wall surface 231 facing the center of the cavity 30, the bottom wall surface 232 spaced from the upper positioning projection 15 to define the third avoidance gap, and the two second slot wall surfaces 233 arranged opposite each other in the circumferential direction of the rear frame 21.

At least one of a connection of the first slot wall surface 231 with the top surface of the rear frame 21 and a connection of the two second slot wall surfaces 233 with the top surface of the rear frame 21 is arranged with a guiding bevel or curved surface, for expanding an upper opening of the lower positioning recess 23.

In the embodiments, during the protective cover 10 is assembled from top to bottom, when the upper positioning projection 15 deviates from the center of the lower positioning recess 23 and abuts against the guiding bevel or curved surface, the upper positioning projection 15 may automatically slide into the lower positioning recess 23 under the guiding effect of the guiding bevel or curved surface.

Further, referring to FIG. 2, FIG. 3, FIG. 5, and FIG. 6, to increase the friction between the rear frame 21 and the side of the electronic device 200, the inner wall surface of the rear frame 21 is arranged with multiple friction patterns extending along the circumferential direction of the rear frame 21. To facilitate the removal of the protective cover 10 or the bottom shell 20, the top surface of the rear frame 21 defines a removal slot at a connection with the outer side, and the removal slot is disposed at four end corners of the rear frame 21 in order to increase the force arm.

Further, referring to FIG. 1, FIG. 2, FIG. 8, FIG. 10, FIG. 21, and FIG. 31 to FIG. 33, the protective film 18 is notched facing a sound hole of the electronic device 200 to cover the display of the electronic device 200 more fully. The front frame 11 is arranged with an array of air permeable holes facing the sound hole of the electronic device 200.

Further, referring to FIGS. 1, 2, and 10 to 20, the front frame 11 defines an annular mounting slot 13 at the inner edge of the front frame 11, the mounting slot 13 including a first limiting surface 131 and a second limiting surface 132, the first limiting surface 131 facing the electronic device 200 and the second limiting surface 132 being a striprel-shaped arc facing the center of the protective film 18.

The protective film 18 includes a rigid film layer 181 and a soft adhesive layer 182 adhesively fixed to an inner surface of the rigid film layer 181, the rigid film layer 181 is disposed between the first limiting surface 131 and the soft adhesive layer 182, and a fourth avoidance gap G5 is defined between the outer circumference of the rigid film layer 181 and the second limiting surface 132; the soft adhesive layer 182 is fixedly connected to the lower surface of the front frame 11.

In the embodiments, the annular mounting slot 13 may be with multiple notches, for example, some notches with small width to adapt to the electronic device's sound outlet hole or microphone entrance. It is understood that the avoidance gap G5 may be a full circle or multiple segments, as long as formed in a predetermined region. For example, to focus on preventing white edges on a long side of the rectangular electronic device, the avoidance gap G5 may be defined only on the long side; while on the opposite other side, the outer peripheral surface of the soft film layer 181 may be in contact with the second limiting surface 132. By arranged a circle or multiple segments of the fourth avoidance gap G5 at the periphery of the rigid film layer 181, when a corresponding position of the front frame 11 is subjected to an inward squeezing force, the transverse deformation of the front frame 11 may be isolated by the avoidance gap G5, and the transverse stress transmitted to the edge of the rigid film layer 181 is less; when the corresponding position of the front frame 11 is subjected to a downward squeezing force, the longitudinal deformation of the front frame 11 may also be isolated by the avoidance gap G5. Therefore, the protective film 18 may be kept in its original state in both cases, avoiding the defect of forming white edges in the process of using the protective cover 10.

Figure 14:
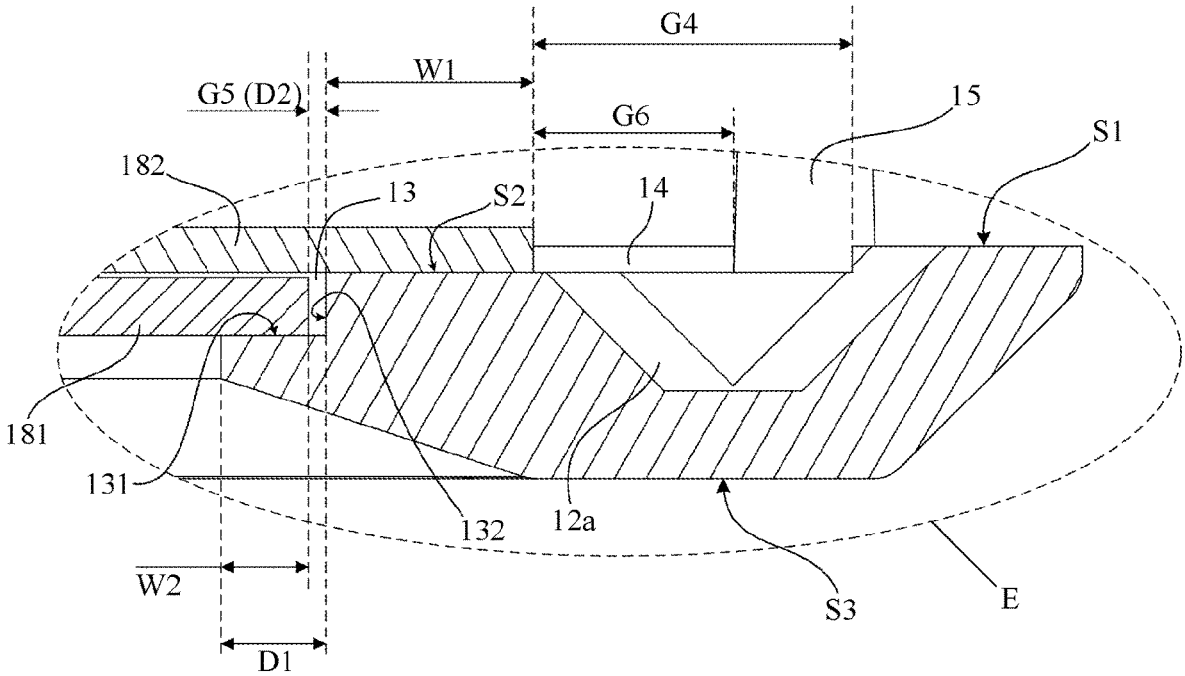
FIG. 14 is an enlarged view of region E circumscribed in FIG. 13.
Figure 15:
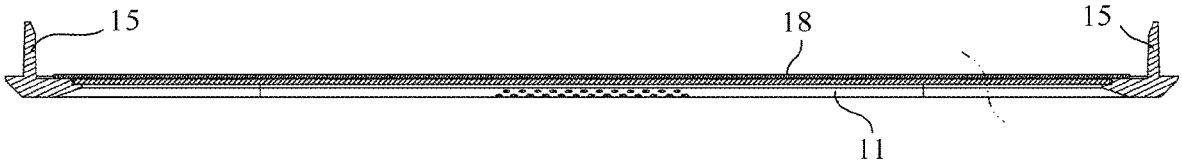
FIG. 15 is a sectional structural schematic view along line XV-XV in FIG. 11.
Figure 16:
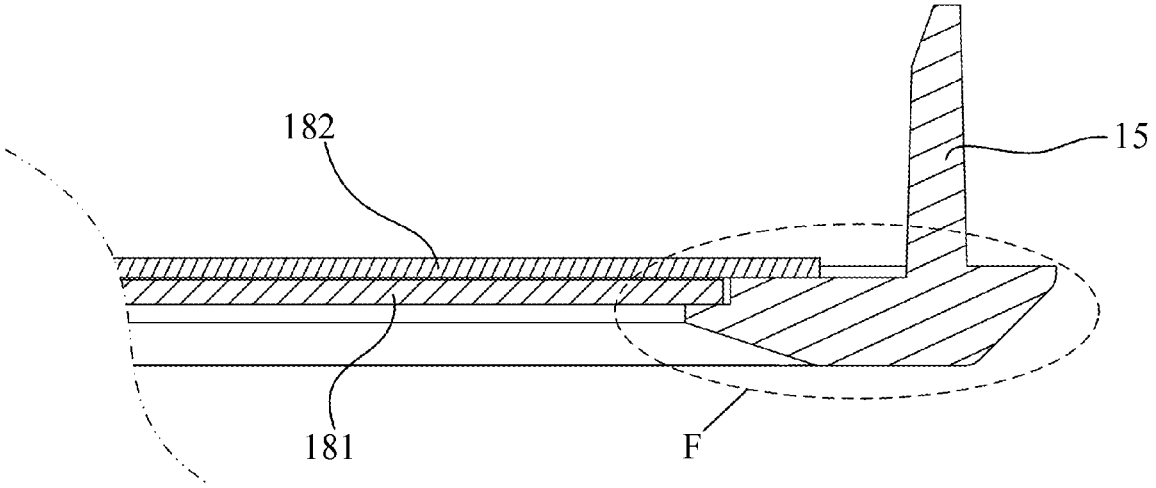
FIG. 16 is a partial structural schematic view on a right side in FIG. 12.
Figure 17:
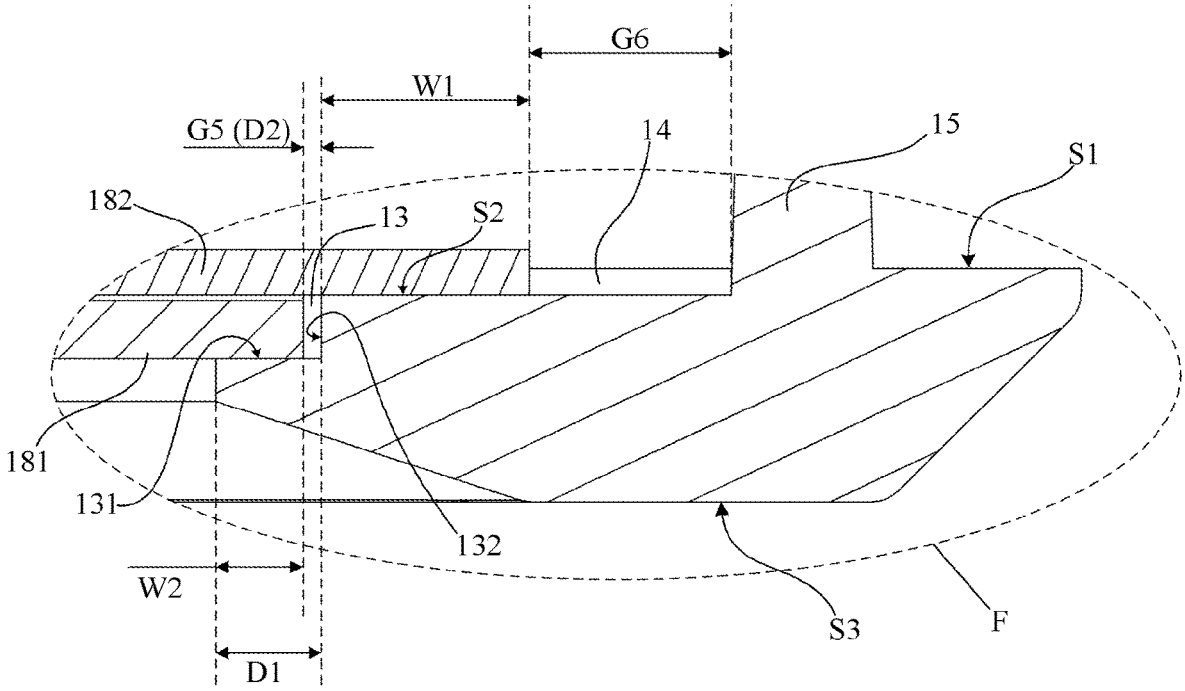
FIG. 17 is an enlarged view of region F circumscribed in FIG. 13.
Figure 18:
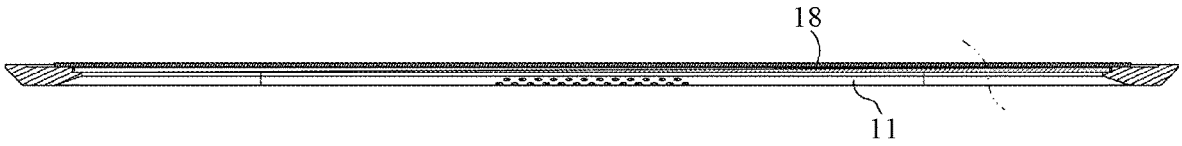
FIG. 18 is a sectional structural schematic view along line XVIII-XVIII in FIG. 11.
Figure 19:
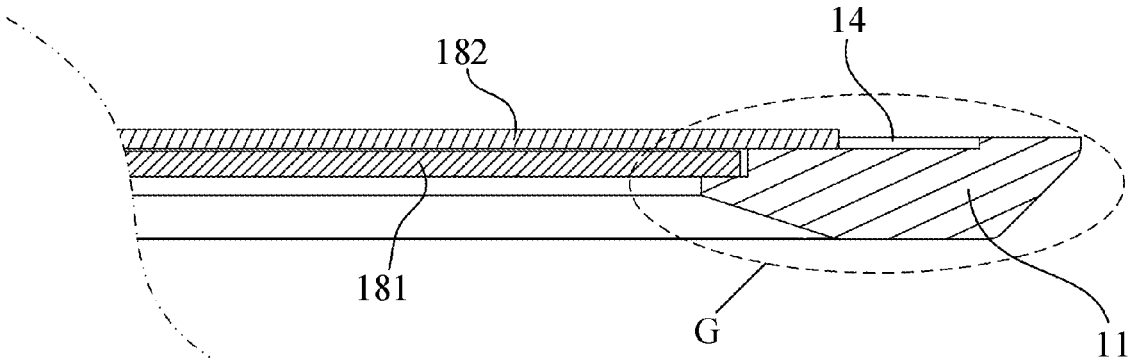
FIG. 19 is a partial structural schematic view on a right side in FIG. 12.
Figure 20:
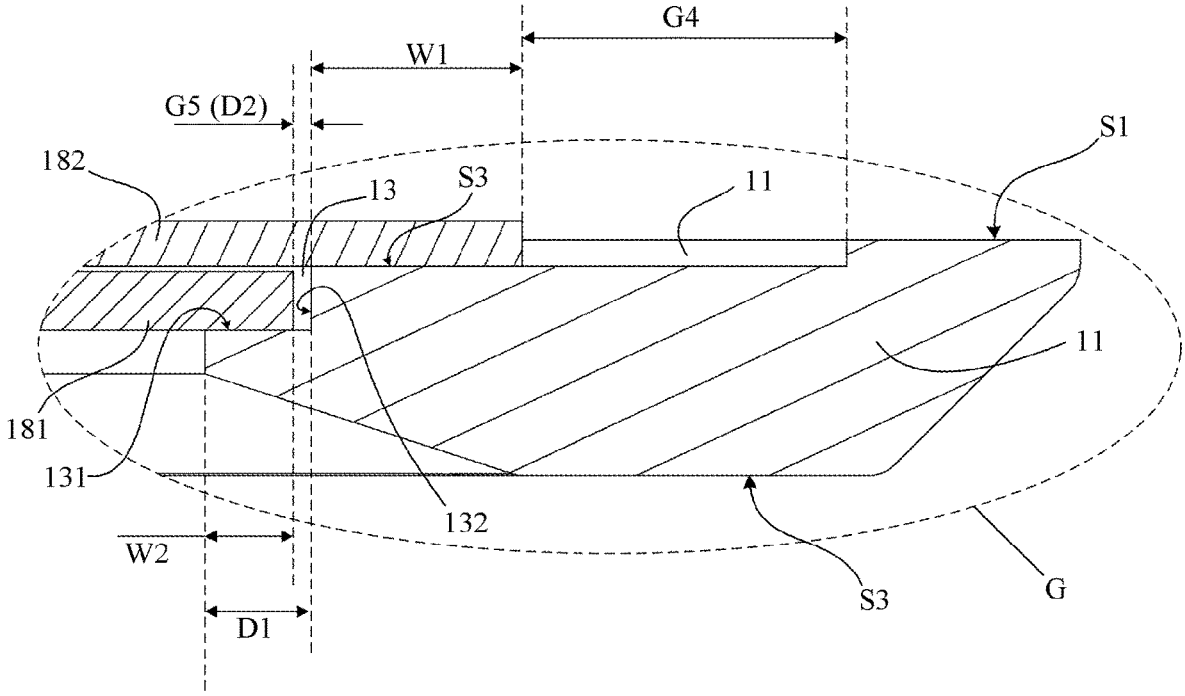
FIG. 20 is an enlarged view of region G circumscribed in FIG. 13.
Figure 21:
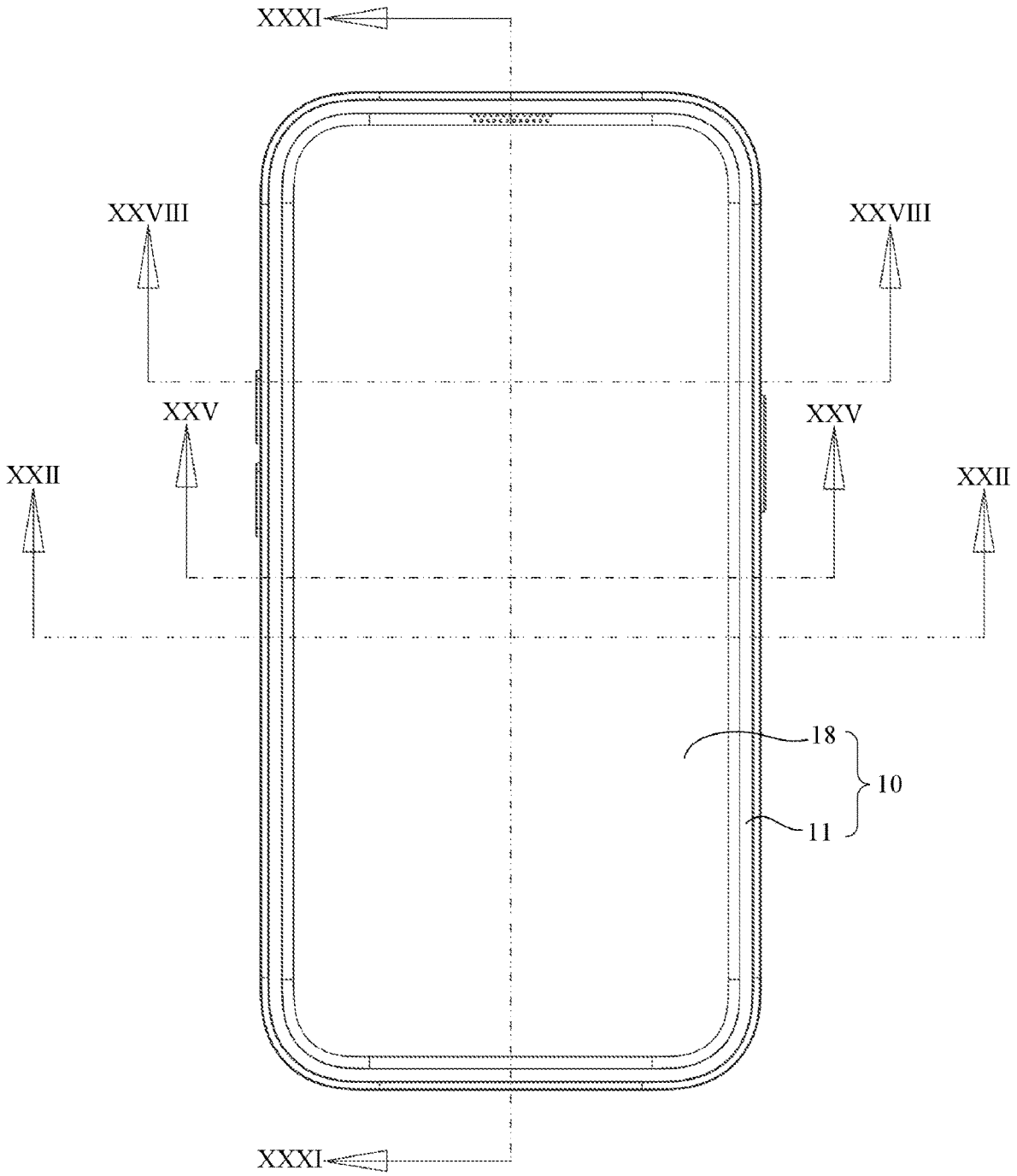
FIG. 21 is a schematic view of a frontal projection of the structure in FIG. 1.
Figure 22:
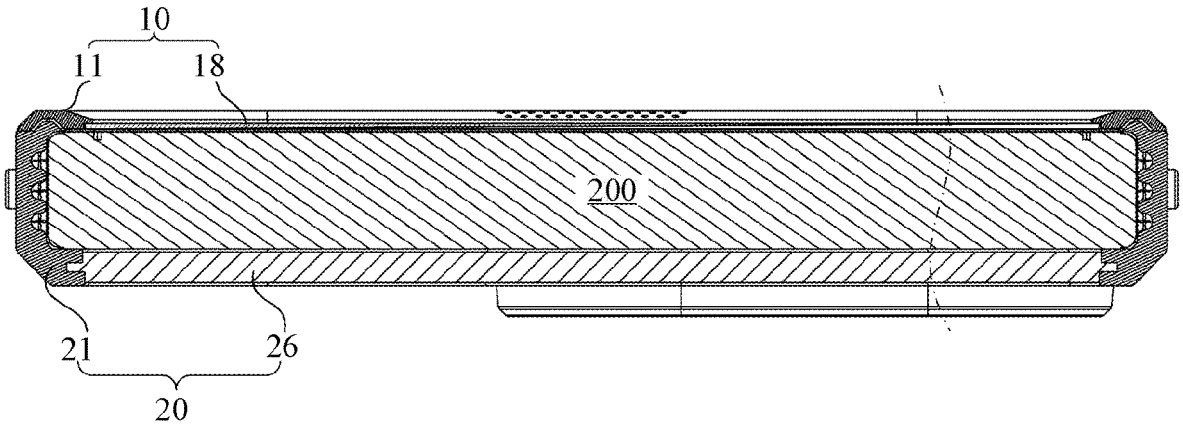
FIG. 22 is a sectional structural schematic view along line XXII-XXII in FIG. 21.
Figure 23:
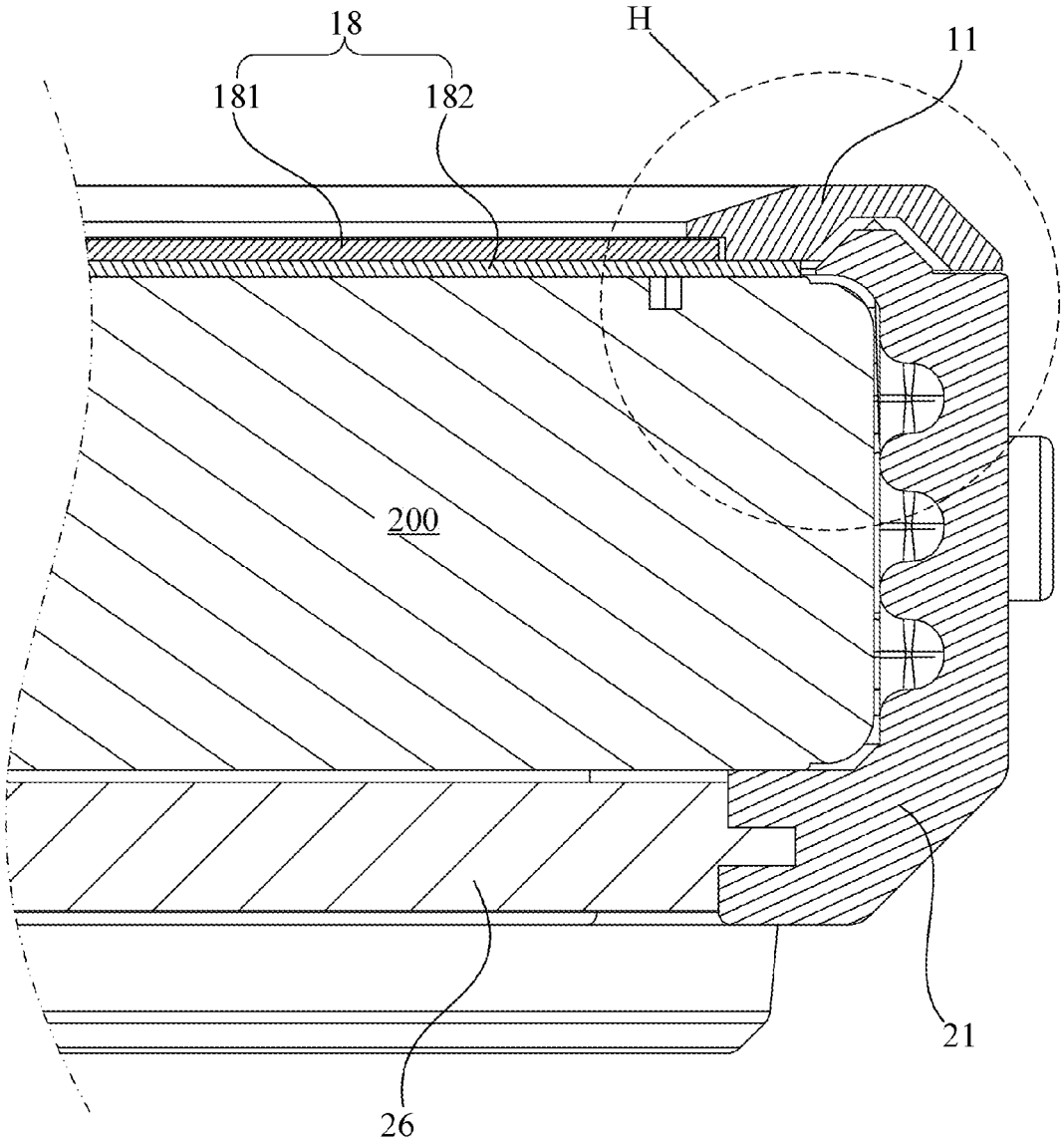
FIG. 23 is a partial structural schematic view on a right side in FIG. 22.
Figure 24:
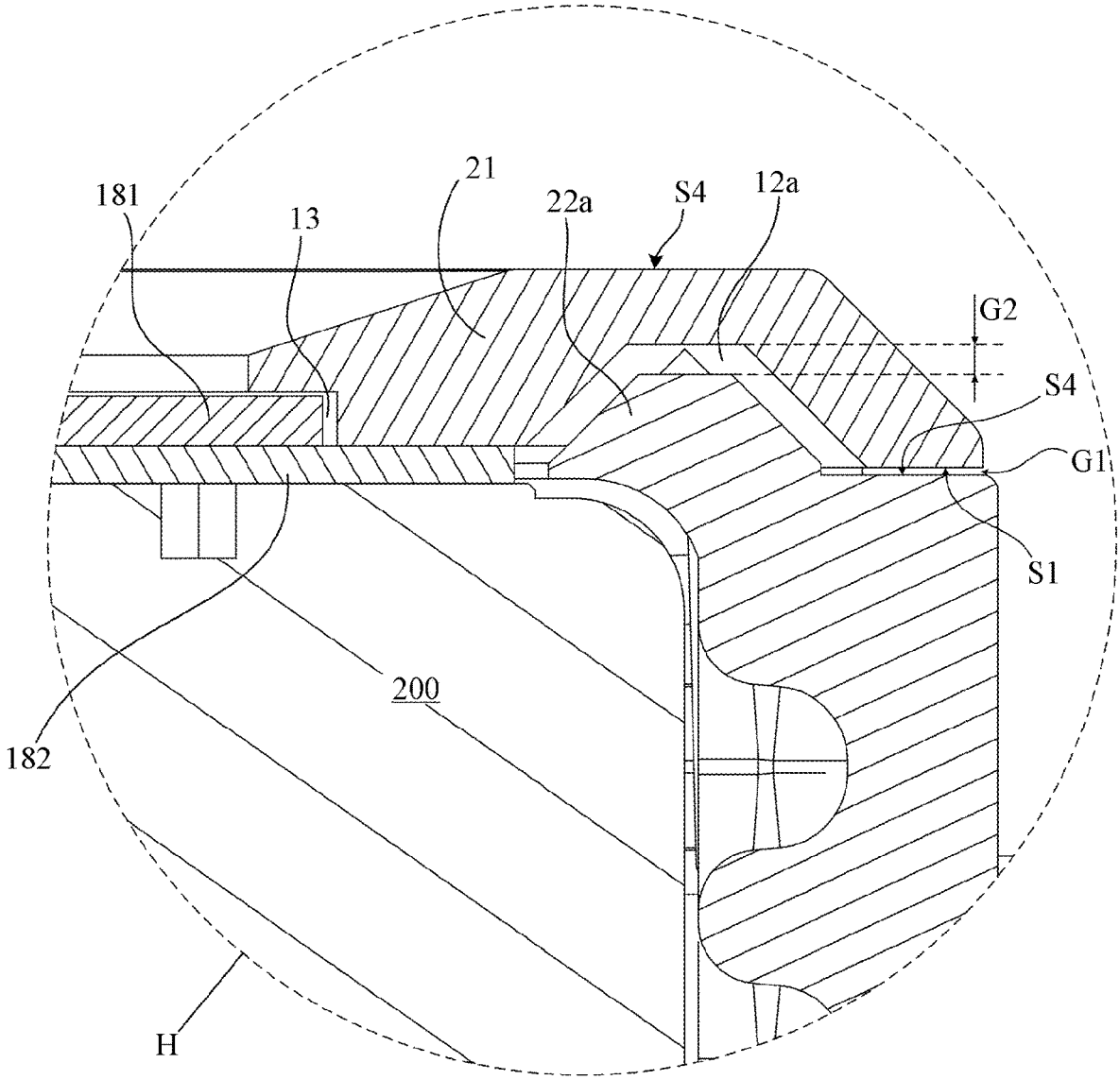
FIG. 24 is an enlarged view of region H circumscribed in FIG. 22.
Figure 25:
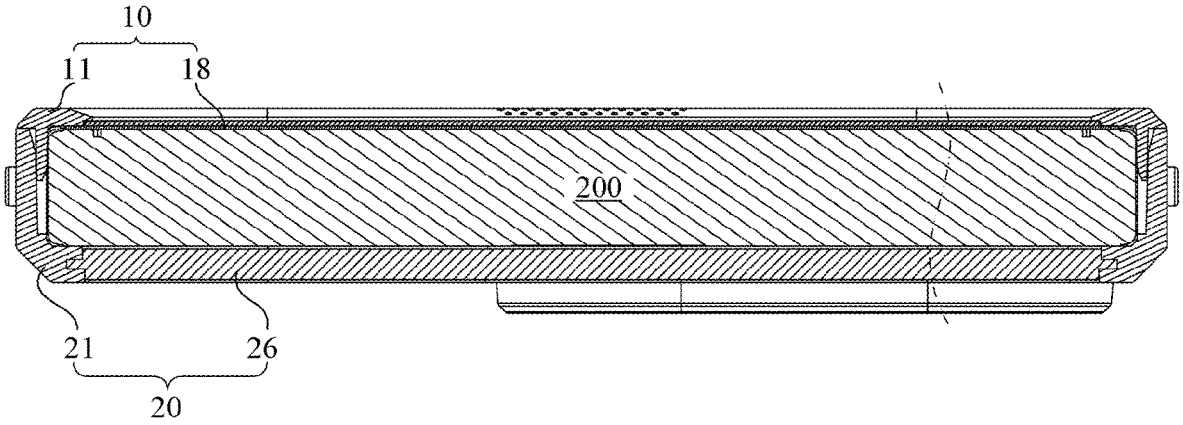
FIG. 25 is a sectional structural schematic view along line XXV-XXV in FIG. 21.
Figure 26:
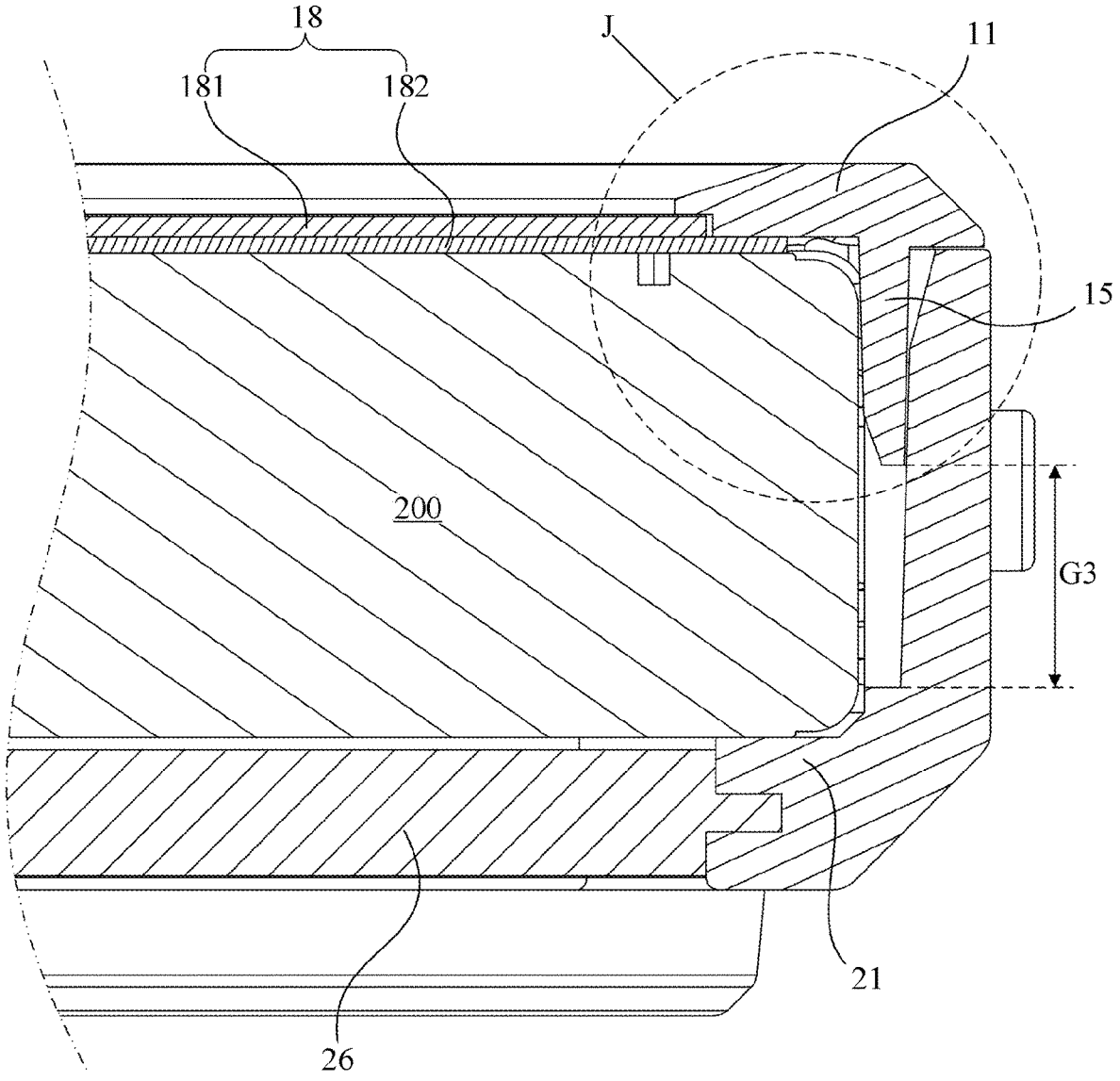
FIG. 26 is a partial structural schematic view on a right side in FIG. 22.
Figure 27:
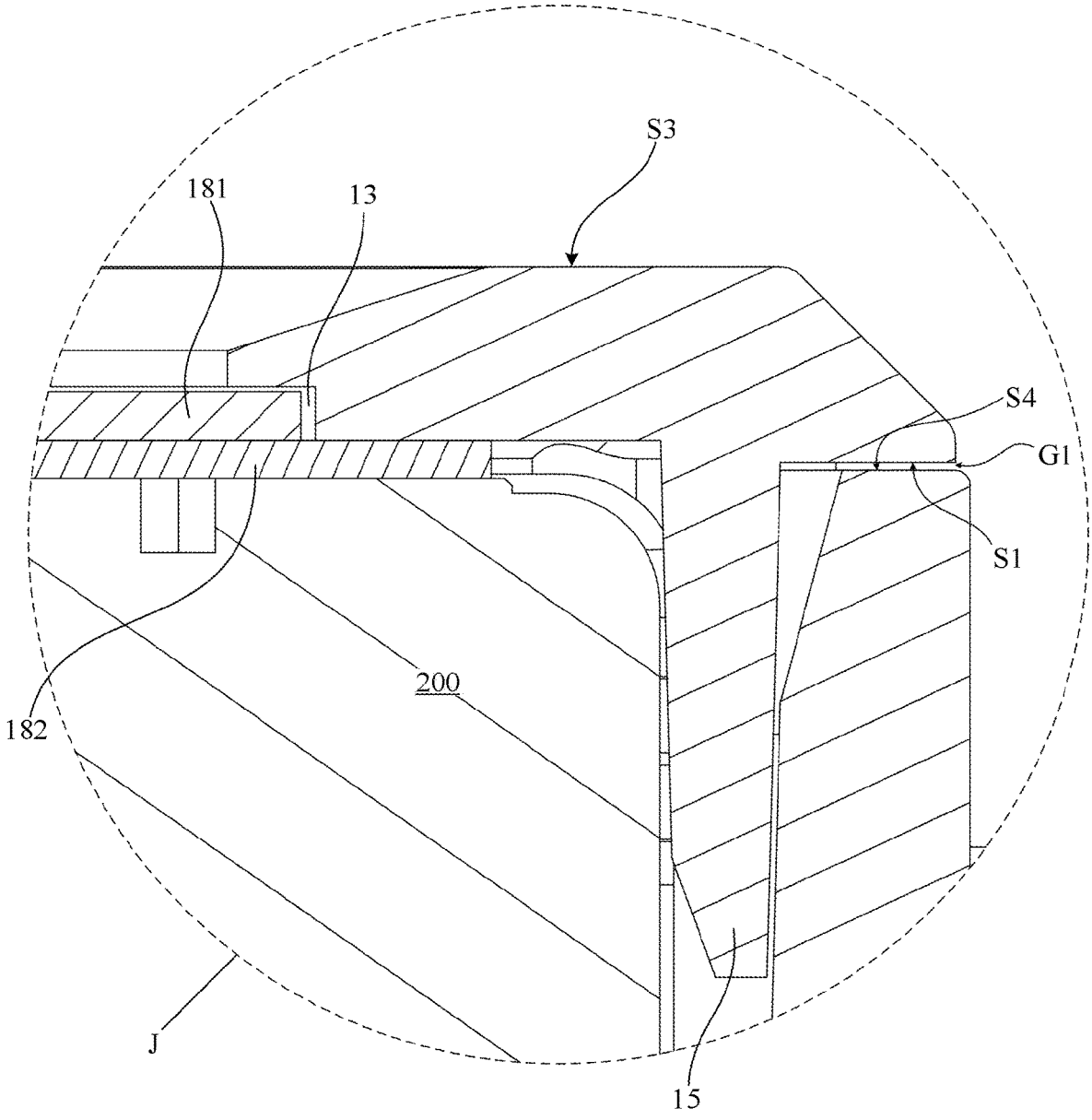
FIG. 27 is an enlarged view of region J circumscribed in FIG. 22.
Figure 28:
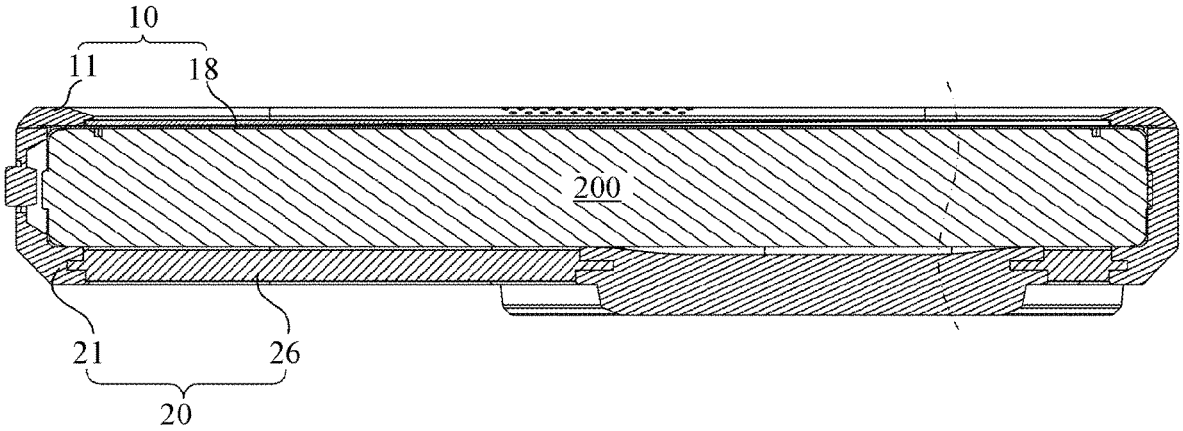
FIG. 28 is a sectional structural schematic view along line XXVIII-XXVIII in FIG. 21.
Figure 29:
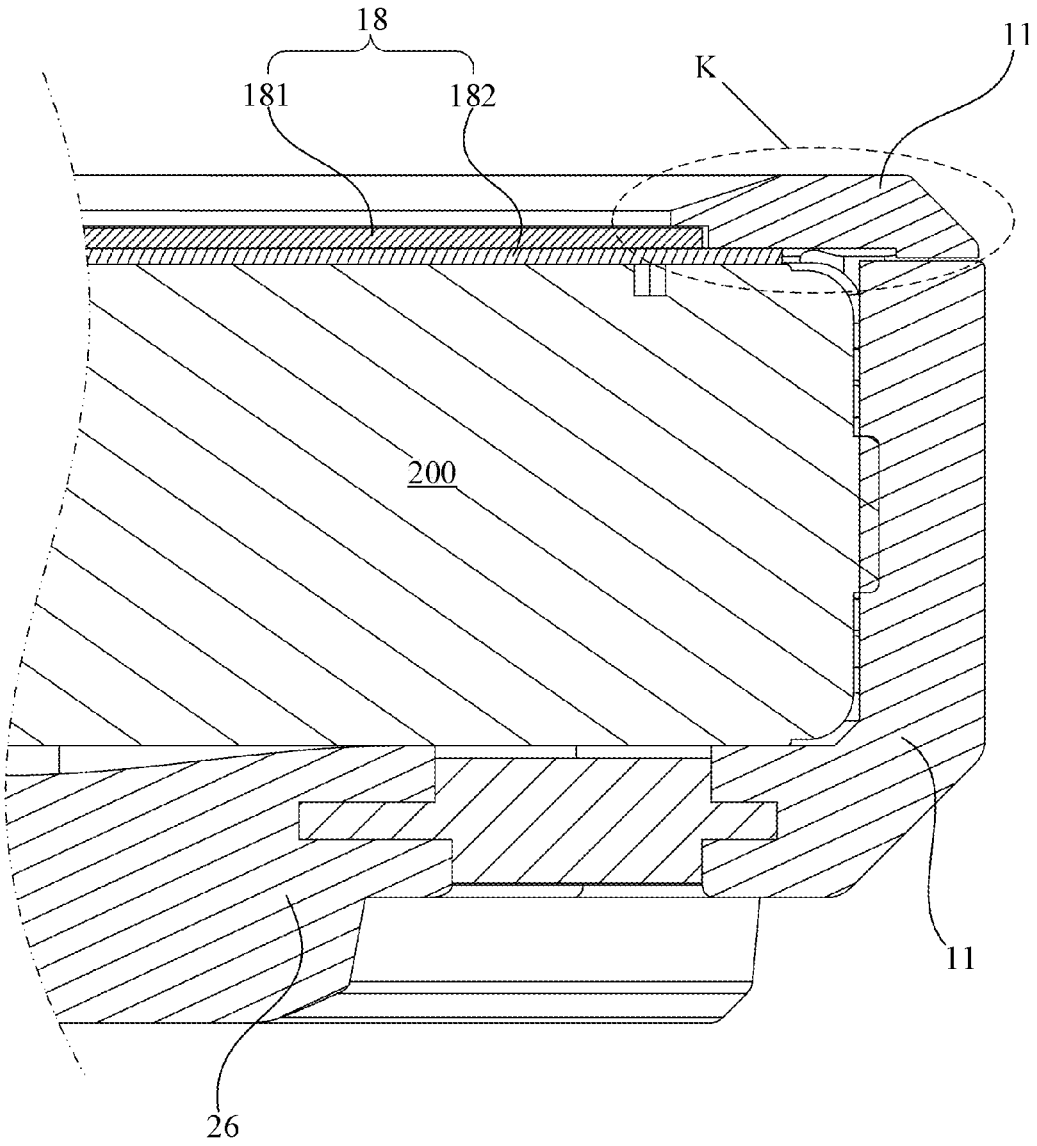
FIG. 29 is a partial structural schematic view on a right side in FIG. 22.
Figure 30:
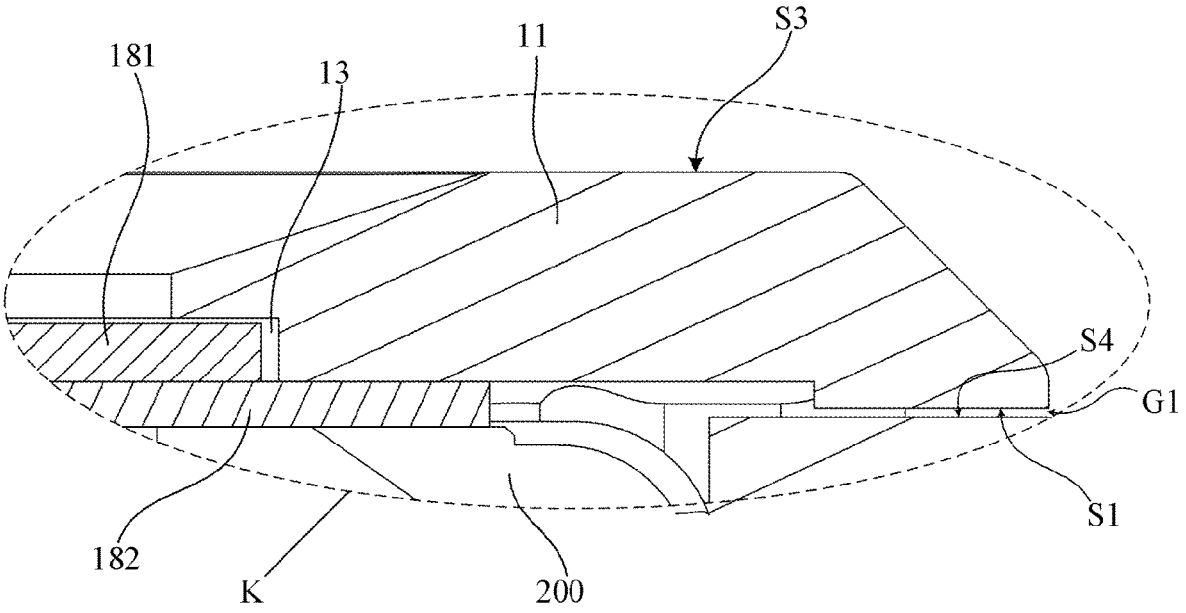
FIG. 30 is an enlarged view of region K circumscribed in FIG. 22.
Figure 31:
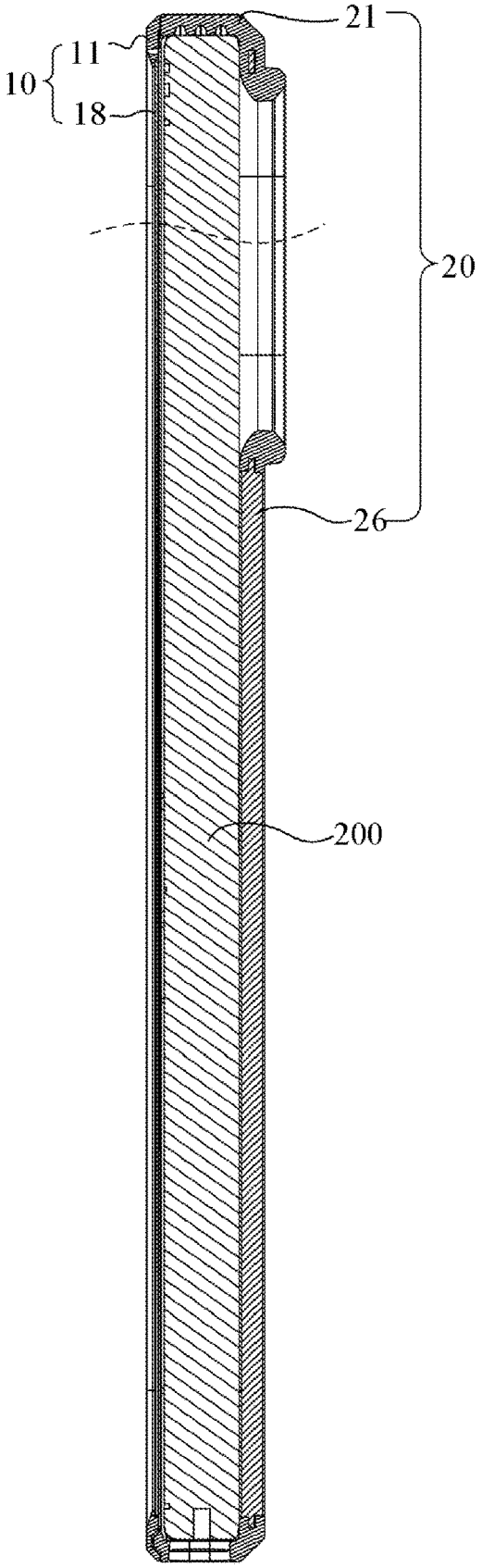
FIG. 31 is a sectional structural schematic view along line XXXI-XXXI in FIG. 21.
Figure 32:
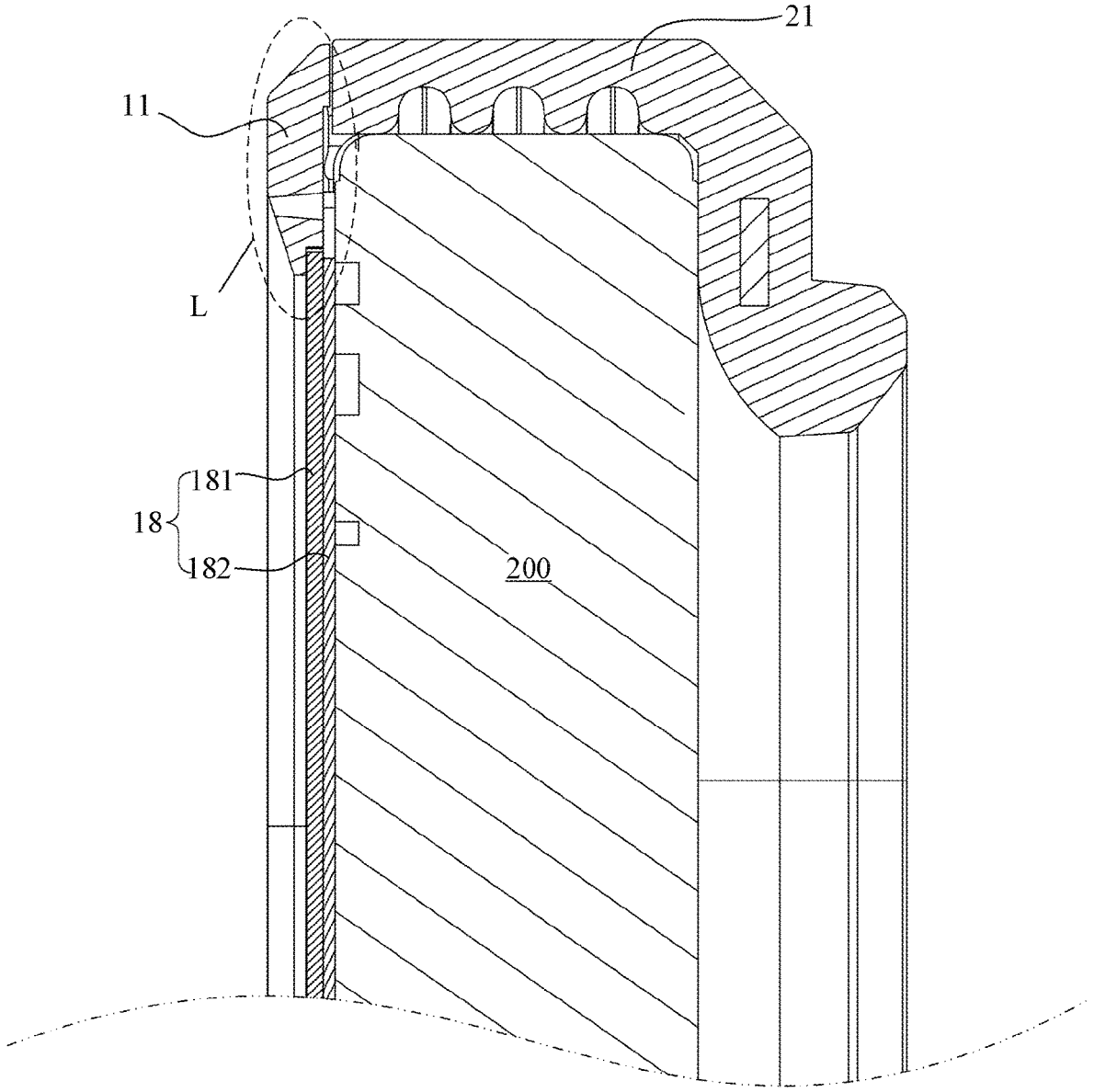
FIG. 32 is a partial structural schematic view on a right side in FIG. 22.
Figure 33:
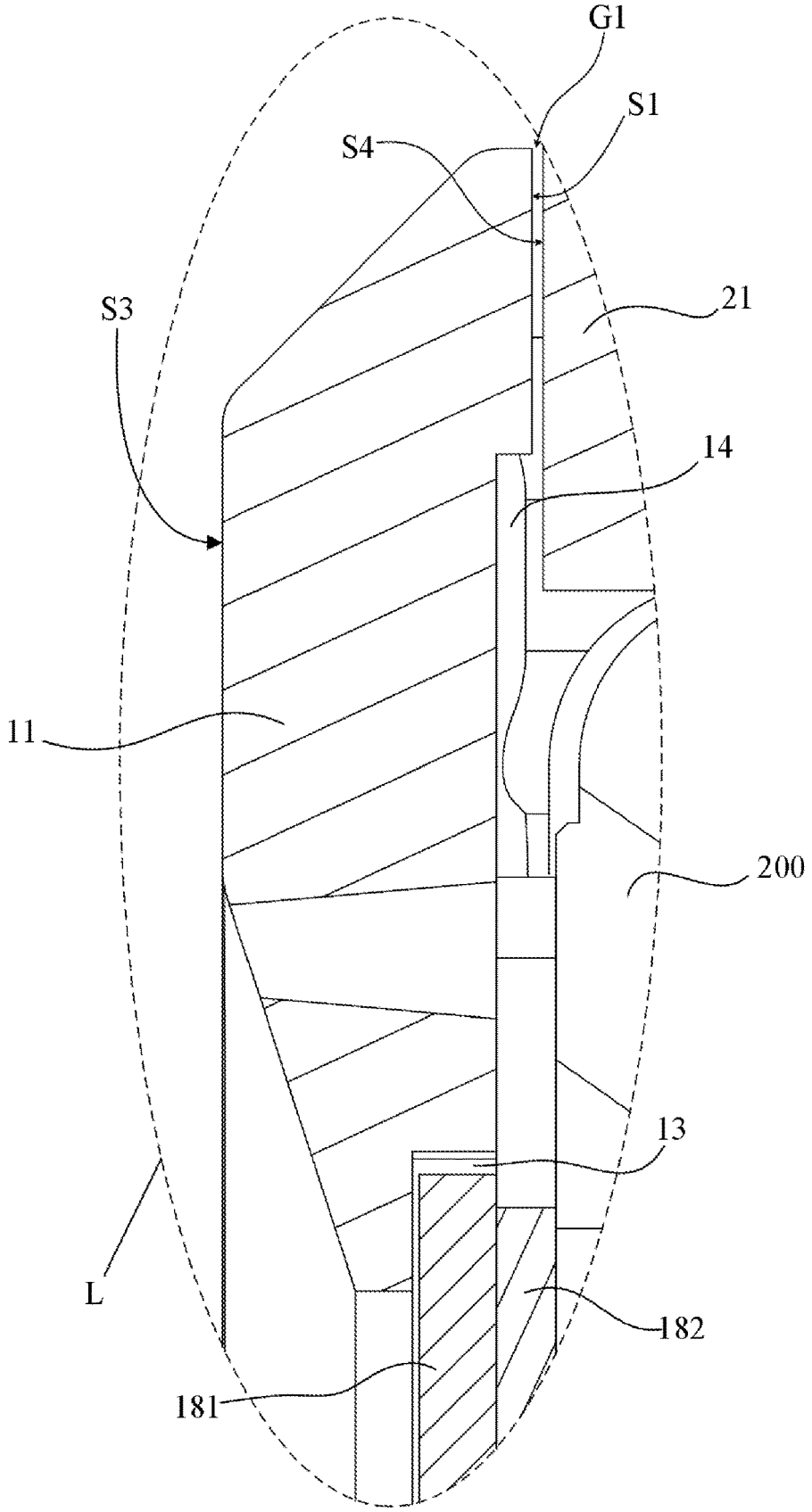
FIG. 33 is an enlarged view of region L circumscribed in FIG. 22.

Further, referring to FIG. 14, FIG. 17, and FIG. 20, to reduce the risk of detaching the protective film 18 layer from the front frame 11, the width of the first limiting surface 131 is D1, and the width of the first avoidance gap is D2, with D2 being less than one-half of D1.

Further, to ensure the isolation effect of the fourth avoidance gap G5, the width of the first avoidance gap is greater than or equal to 10 microns.

Further, the bottom surface of the front frame 11 defines an exhaust slot 14 surrounding the soft adhesive layer 182, and the exhaust slot 14 is in communication with the mounting slot 13; the soft adhesive layer 182 is fixedly connected to the bottom surface of the exhaust slot 14, and the second avoidance gap G4 is defined between the soft adhesive layer 182 and a side of the exhaust slot 14.

In the embodiments, defining the exhaust slot 14 may increase the flexibility of the edge part of the front frame 11, thereby increasing the overall flexibility of the protective cover 10 and facilitating the attachment operation, and may accelerate the exhaust between the protective cover 10 and the screen of the electronic device 200, so that the attachment operation takes less time, which further optimizes the user's use experience.

Further, to ensure the strength of a connection between the soft adhesive layer 182 and the front frame 11, and to avoid the additional application of liquid glue to increase the fixation strength to prevent the protective film 18 from "unframing", the width of the annular region of the soft adhesive layer 182 attached to the front frame 11 is W1 on one side, and the width of the annular region of the hard film layer 181 embedded in the mounting slot 13 is W2 on one side, with W1 being greater than W2.

Further, referring again to FIG. 10, the front frame 11 is a rectangular frame including two first long frame strips 16 arranged opposite each other, and two first short frame strips 17 arranged opposite each other, the two first long frame strips 16 and the two first short frame strips 17 being connected end to end to form the rectangular frame.

Each first long frame strip 16 is arranged with an upper positioning projection 15, and the bottom surface of the first short frame strip 17 is left empty or slotted to be flush with or above the bottom surface of the second long frame strip 24.

In the embodiments, the front frame 11 is arranged as a rectangular frame so that it can better match with the rounded rectangular tablet phone or electronic device 200. For the first long frame strip 16 and the first short frame strip 17, the bottom surface of the first short frame strip 17 (subject to the state of the first limiting surface 131 facing downward) is left empty or slotted to be flush with or above the bottom surface of the first long frame strip 16, so that a roller that applies pressure to the adhesive can roll the soft adhesive layer 182 in the direction perpendicular to the first short frame strip 17 to ensure the strength of the connection between the soft adhesive layer 182 and the front frame 11.

Further, referring to FIGS. 12 to 20, the thickness between the bottom surface S1 and the top surface S3 of the front frame 11 is 1.5 times to 3 times the thickness of the protective film 18, and the bottom surface of the exhaust slot 14 defines the upper positioning recesses 12*a*, 12*b*. The depth of the upper positioning recesses 12*a*, 12*b* is less than the height of the upper positioning projection 15. In the embodiments, since the thickness of the protective film 18 is usually small, the thickness of the front frame 11 is limited to a less value with reference to the thickness of the protective film 18, so that the protective cover 10 as a whole tends to be more of a plate-like structure, thereby making the protective cover 10 easier to bend, i.e., while preventing the protective film 18 from coming off the frame and protecting the edge part of the protective film 18, it is also easy to implement the attachment operation of the protective film 18. The depth of the upper positioning recesses 12*a*, 12*b* is less than the height of the upper positioning projection 15, which may reduce the influence of the upper positioning recesses 12*a*, 12*b* on the structural strength of the front frame 11 and increase the positioning travel of the upper positioning projection 15. The upper positioning recesses 12*a*, 12*b* are defined in the exhaust recess 14 to facilitate the exhaust of the lower positioning projections 22*a*, 22*b*.

Further, the central part of each first long frame strip 16 is arranged with two upper positioning protrusions 15 arranged at intervals in the length direction of the first long frame strip 16, and an upper positioning recess 12*a*, 12*b* is arranged between the two upper positioning protrusions 15. It is understood that the upper positioning projections 15 and the upper positioning recess on each of the first long frame strips 16 are arranged alternately, making the relevant positioning structures more complementary and thus enabling better positioning effect. It is understood that the upper positioning projection 15 and the upper positioning recess 12*a*, 12*b* are not limited to fit only to the bottom housing 20, but both structures can also fit directly to corresponding structures on the electronic device 200.

Further, the rigid film layer 181 is movably matched with the first limiting surface 131. Therefore, when the outer edge of the front frame 11 is subjected to squeezing pressure, the first limiting surface 131 can be tangentially misaligned with respect to the rigid film layer 181 to avoid transferring the deformation to the rigid film layer 181, thereby reducing the attachment effect on the rigid film layer 181 and preventing white edges on the edge of the rigid film layer 181.

Further, referring to FIGS. 1, 2, and 10 to 20, the lower surface of the front frame 11 has an adhesive surface S2 adjacent to the second limiting surface 132.

The protective film 18 includes a rigid film layer 181 and a soft adhesive layer 182 adhesively fixed to an inner surface of the rigid film layer 181, and the rigid film layer 181 is disposed between the first limiting surface 131 and the soft adhesive layer 182. The distance between the adhesive surface S2 and the first limiting surface 131 in the thickness direction of the electronic device 200 is greater than the thickness of the rigid film layer 181, the rigid film layer 181 and the first limiting surface 131 are separably matched, and the soft adhesive layer 182 is fixedly connected to the adhesive surface S2.

It is understood that when the distance between the adhesive surface S2 and the first limiting surface 131 is less than the thickness of the rigid film layer 181 in the thickness direction of the electronic device 200, after the protective film 18 is turned over so that the first limiting surface 131 is set upward, the rigid film layer 181 protrudes from the adhesive surface S2 and the soft adhesive layer 182 laps at an angle to the adhesive surface S2, thereby defining a wedge-shaped cavity between the adhesive surface S2 and the soft adhesive layer. The part of the adhesive surface S2 closer to the rigid film layer 182 and the soft adhesive layer 182 are actually in a state of separation from each other. In the embodiments, the distance between the adhesive surface S2 and the first limiting surface 131 is greater than the thickness of the rigid film layer 181 in the thickness direction of the electronic device 200.

In this way, in the production stage, after the rigid film layer 181 is attached to the first limiting surface 131, the adhesive surface S2 may be relatively protruding from a side of the rigid film layer 181 attached to the soft adhesive layer 182, so that the edge part of the soft adhesive layer 182 matched with the adhesive surface S2 is subjected to a higher squeezing pressure and can be fully attached under the squeezing action of the roller. Therefore, the soft adhesive layer 182 has a higher attachment strength with the front frame 11 without the need to apply additional liquid glue to increase the fixing strength, thereby preventing the protective film 18 from "unframing".

During the attachment process, with the electronic device 200 on the bottom and the protective cover 10 on the top, the protective film 18 drives the rigid film layer 181 out of the first limiting surface 131 under the action of gravity, and the protective film 18 is basically in a naturally extended state. The inner surface of the protective film 18 is flatter, so that when the screen of the electronic device 200 is attached, the air bubbles between the two are more easily eliminated, thereby reducing the difficulty for users to achieve a "bubble-free" attachment.

Further, to create a large enough pressure difference on the soft adhesive layer 182 when rolling the soft adhesive layer 182, the difference between the distance between the adhesive surface S2 and the first limiting surface 131 and the thickness of the hard film layer 181 is greater than or equal to 0.03 mm.

Further, the lower surface of the front frame 11 includes a bottom surface S1, and the bottom surface of the front frame 11 defines an exhaust slot 14 surrounding the soft adhesive layer 182, and the exhaust slot 14 is in communication with the mounting slot 13, and the adhesive surface S2 is formed on the bottom surface of the exhaust slot 14. In the embodiments, defining the exhaust slot 14 may increase the flexibility of the edge part of the front frame 11, thereby increasing the overall flexibility of the protective cover 10 and facilitating the attachment operation, and may accelerate the exhaust between the protective cover 10 and the screen of the electronic device 200, so that the attachment operation takes less time, which further optimizes the user's use experience.

Further, referring to FIG. 14, FIG. 17 and FIG. 20, to ensure the strength of the connection between the soft adhesive layer 182 and the front frame 11, and to avoid the additional application of liquid glue to increase the fixation strength for preventing the protective film 18 from "unframing", the width of the annular region of the soft adhesive layer 182 attached to the front frame 11 is W1 on one side, and the width of the annular region of the hard film layer 181 embedded in the mounting slot 13 is W1. In some embodiments, W1 is greater than or equal to 2 times W2.

Further, to achieve fast exhausting, as well as to facilitate the roller to pass when rolling the soft rubber layer 182, there is an avoidance gap G4 defined between the soft rubber layer 182 and the side of the exhaust slot 14.

Further, the bottom surface of the exhaust slot 14 is arranged with an upper positioning projection 15, and the top surface of the rear frame 21 defines a lower positioning recess 23, and an avoidance gap G3 is defined between the upper positioning projection 15 and the lower positioning recess 23 in the thickness direction of the electronic device 200; and an avoidance gap G6 is defined between the soft rubber layer 182 and the upper positioning projection 15.

In the embodiments, the upper positioning projection 15 and the lower positioning recess 23 cooperate to help the user position the protective cover 10 and pave the way for the subsequent attachment work. Arranging the upper positioning projection 15 on the front frame 11 is conducive to making the height of the front frame 11 low while ensuring the structural strength of the front frame 11. Setting the avoidance gap G3 may avoid the positioning fit between the upper positioning projection 15 and the lower positioning recess 23 from affecting the adaptability of the height of the cavity 30 between the protective film 18 and the bottom plate 26 of the bottom shell 20 and the thickness of the electronic device 200. By setting the avoidance gap G6, it is possible to facilitate the roller to pass when rolling to connect the soft rubber layer 182 with the front frame 11.

Finally, it should be noted that the above embodiments are only intended to illustrate the technical solution of the present disclosure, not to limit the present disclosure; despite the detailed description of the present disclosure with reference to the foregoing embodiments, it is understood by those skilled in the art that it is still possible to modify the technical solution recorded in the foregoing embodiments, or to make equivalent substitutions for some of the technical features thereof; and these modifications or substitutions do not drive the essence of the corresponding technical solutions from the spirit and scope of the technical solutions of the embodiments of the present disclosure.

What is claimed is:

1. A one-piece structure of a shell and a film, comprising: a protective cover and a bottom shell; wherein, the protective cover comprises a front frame and a protective film, the front frame being arranged on an outer edge of the protective film;

the bottom shell comprises a rear frame and a bottom plate arranged on the rear frame; the bottom plate is arranged opposite to the protective film, and the bottom shell is matched with the protective cover to enclose a cavity for accommodating the electronic device;

an inner surface of the protective film is adhesively fixed to a screen of the electronic device, and the bottom shell is fixedly connected to the electronic device;

an avoidance gap is defined between the bottom shell and the protective cover in a thickness direction of the electronic device; and/or the bottom shell is in elastic contact with the protective cover in the thickness direction of the electronic device;

wherein a bottom surface of the front frame and a top surface of the rear frame are arranged opposite each other in the thickness direction of the electronic device and define a first avoidance gap;

wherein the top surface of the rear frame is arranged with a lower positioning projection, and the bottom surface of the front frame is arranged with an upper positioning recess facing the lower positioning projections; the lower positioning projection is disposed in the upper positioning recess, and a second avoidance gap is defined between the lower positioning projection and the upper positioning recess in the thickness direction of the electronic device; in a direction parallel to the screen of the electronic device and toward a center of the screen of the electronic device, the second avoidance gap is closer to the protective film than the first avoidance gap; in the thickness direction of the electronic device, the second avoidance gap is larger than the first avoidance gap;

wherein in the thickness direction of the electronic device, a thickness between the bottom surface and a top surface of the front frame is less than a height of the rear frame; the bottom surface of the front frame is arranged with an upper positioning projection and the top surface of the rear frame defines a lower positioning recess, and a third avoidance gap is defined between the upper positioning projection and the lower positioning recess in the thickness direction of the electronic device; a height of the upper positioning projection is greater than a height of the lower positioning projection; in the direction parallel to the screen of the electronic device and toward the center of the screen of the electronic device, the third avoidance gap is closer to the protective film than the first avoidance gap; in the thickness direction of the electronic device, the third avoidance gap is larger than the first avoidance gap, and the third avoidance gap is smaller than the second avoidance gap.

2. The one-piece structure according to claim 1, wherein the lower positioning projection is arranged at a connection between the top surface of the rear frame and an inner wall surface of the rear frame, and the lower positioning projection protrudes from the inner wall surface of the rear frame to fasten a front side of the electronic device.

3. The one-piece structure according to claim 2, wherein a side of the lower positioning projection back from the upper positioning recess is a concave arc surface.

4. The one-piece structure according to claim 1, wherein the lower positioning projection comprises a plurality of lower positioning projections, and the plurality of lower positioning projections are arranged at intervals along a circumference of the rear frame.

5. The one-piece structure according to claim 1, wherein a mounting slot is defined at a connection between the bottom surface and an inner peripheral surface of the front frame, and the bottom surface of the front frame defines an exhaust slot, being annular in shape, at a periphery of the mounting slot; the exhaust slot is in communication with the mounting slot and the upper positioning recess, and an edge of the protective film is fixedly arranged in the mounting slot.

6. The one-piece structure according to claim 1, wherein the lower positioning protrusion extends along a circumferential direction of the rear frame and is strip-shaped.

7. The one-piece structure according to claim 6, wherein an upper surface of the lower positioning protrusion has a trapezoidal or triangular cross-sectional shape that tapers from a bottom to a top, and an inner wall surface of the upper positioning recess has a shape matched with the lower positioning protrusion.

8. The one-piece structure according to claim 1, wherein in the thickness direction of the electronic device, a height of the bottom surface of the front frame is close to a height of the inner surface of the protective film, and the thickness between the bottom surface and the top surface of the front frame is 1.5 times to 3 times of a thickness of the protective film.

9. The one-piece structure according to claim 8, wherein, the front frame and the rear frame are both rectangular frames, the front frame comprising two first long frame strips arranged opposite each other and two first short frame strips arranged opposite each other, and the rear frame comprising two second long frame strips arranged opposite each other and two second short frame strips arranged opposite each other;

the upper positioning projection comprises a plurality of upper positioning projections, and the upper positioning recess comprises a plurality of upper positioning recesses; the lower positioning recess comprises a plurality of lower positioning recesses, and the lower positioning projection comprises a plurality of lower positioning projections;

a central part of each first long frame strip is arranged with two of the plurality of upper positioning projections arranged at intervals in a length direction of the first long frame strip, and one of the plurality of upper positioning recess is arranged between the two upper positioning projections;

a central part of each second long frame strip is arranged with two of the plurality of lower positioning recesses arranged at intervals in a length direction of the second long frame strip, and one of the plurality of lower positioning projections is arranged on a top surface of the second long frame strip between the two lower positioning recesses.

10. The one-piece structure according to claim 1, wherein, the bottom surface of the front frame is arranged with an upper positioning projection, and the top surface of the rear frame defines a lower positioning recess, and a third avoidance gap is defined between the upper positioning projection and the lower positioning recess in the thickness direction of the electronic device; in a direction parallel to the screen of the electronic device and toward a center of the screen of the electronic device, the third avoidance gap is closer to the protective film than the first avoidance gap; in the thickness direction of the electronic device, the third avoidance gap is larger than the first avoidance gap.

11. The one-piece structure according to claim 10, wherein, the lower positioning recess runs through an inner wall surface of the rear frame to define a slot open toward the cavity.

12. The one-piece structure according to claim 11, wherein, the lower positioning recess comprises a first slot wall surface, a bottom wall surface, and two second slot wall surfaces, the first slot wall surface facing a center of the cavity, the bottom wall surface spaced from the upper positioning projection to define the third avoidance gap, and the two second slot wall surfaces arranged opposite each other in a circumferential direction of the rear frame;

at least one of a connection of the first slot wall surface with the top surface of the rear frame and a connection of the two second slot wall surfaces with the top surface of the rear frame is arranged with a guiding bevel or a curved surface, for expanding an upper opening of the lower positioning recess.

* * * * *